US006072752A

United States Patent [19]

Igarashi et al.

[11] Patent Number: 6,072,752

[45] Date of Patent: Jun. 6, 2000

[54] HAND DISPLAY-TYPE ELECTRONIC TIMEPIECE

[75] Inventors: Kiyotaka Igarashi; Kenji Fujita, both of Tokyo; Kunikazu Mochida, Tokorozawa, all of Japan

[73] Assignee: Citizen Watch Co., Ltd., Tokyo, Japan

[21] Appl. No.: 08/759,640

[22] Filed: Dec. 5, 1996

Related U.S. Application Data

[63] Continuation of application No. 08/167,855, filed as application No. PCT/JP93/00551, Apr. 27, 1992, abandoned.

[30] Foreign Application Priority Data

| | | | |
|---|---|---|---|
| Apr. 27, 1992 | [JP] | Japan | 4-107915 |
| Apr. 27, 1992 | [JP] | Japan | 4-107916 |
| Nov. 4, 1992 | [JP] | Japan | 4-317922 |
| Nov. 27, 1992 | [JP] | Japan | 4-341342 |

[51] Int. Cl.[7] ..... G04B 19/04

[52] U.S. Cl. ..... 368/80; 368/187; 368/204

[58] Field of Search ..... 368/74, 203, 204, 368/10, 89, 107–113

[56] References Cited

U.S. PATENT DOCUMENTS 5,280,459 1/1994 Nakamura .

FOREIGN PATENT DOCUMENTS

| | | |
|---|---|---|
| 3200409 C2 | 10/1990 | Germany . |
| 55-89779 | 7/1980 | Japan . |
| 57-13382 | 1/1982 | Japan . |
| 57-201883 | 12/1982 | Japan . |
| 58-14077 | 1/1983 | Japan . |
| 58-182575 | 10/1983 | Japan . |
| 59-18477 | 1/1984 | Japan . |
| 59-138977 | 8/1984 | Japan . |
| 61-8394 | 3/1986 | Japan . |
| 61-38421 | 8/1986 | Japan . |
| 61-61637 | 12/1986 | Japan . |
| 3-14150 | 2/1991 | Japan . |
| 3-45409 | 7/1991 | Japan . |

*Primary Examiner*—Bernard Roskoski
*Attorney, Agent, or Firm*—Finnegan, Henderson, Farabow, Garrett & Dunner, L.L.P.

[57] ABSTRACT

To provide a hand display-type electronic timepiece which is simply constructed, enables the manufacturer or the user of the analog electronic timepiece to easily and correctly accomplish synchronism between the hands and the timing counter, and does not require an operation for bringing the hands and the timing counter into synchronism when the cell is renewed by the user, eliminating the problems inherent in the aforementioned prior art. That is, in a hand display-type electronic timepiece 1 constituted by a cell 2, a time signal generating means 10, a motor drive control means 25, a pulse motor drive means 17, a pulse motor 18, hands 19 driven by the pulse motor, and a hand position data generating means 3 which generates hand position data corresponding to the hands, and in which the drive control of the hands is executed according to the data from the hand position data generating means 3, an analog hand display-type electronic timepiece further comprises a hand drive stop means 11 which stops the hands 19 and the hand position data generating means 3 under the condition in which synchronism is maintained therebetween, a nonvolatile memory 4 for storing hand position data generated from the hand position data generating means 3, a hand drive data control means 5 which controls the nonvolatile memory 4 and the hand drive stop means 11, and a data storage instruction means 6 which operates the control means 5, wherein in response to an instruction signal from the data storage instruction means 6, the hand drive stop means 11 stops the hands 19, and the hand drive data control means 5 writes the data stored in the hand position data generating means 3 into the nonvolatile memory 4.

36 Claims, 24 Drawing Sheets

OSC
9
TIME SIGNAL GEN. MEANS
10
SECOND MOTOR WAVEFORM GEN. CKT.
71
SECOND MOTOR DRIVE MEANS
73
SECOND MOTOR
75
SECOND HAND
77
HOUR/MINUTE MOTOR WAVEFORM GEN. CKT.
72
HOUR/MINUTE MOTOR DRIVE MEANS
74
HOUR/MINUTE MOTOR
76
HOUR AND MINUTE HANDS
78
QUICK-FEED PULSE GEN. CKT.
79
94
93
80

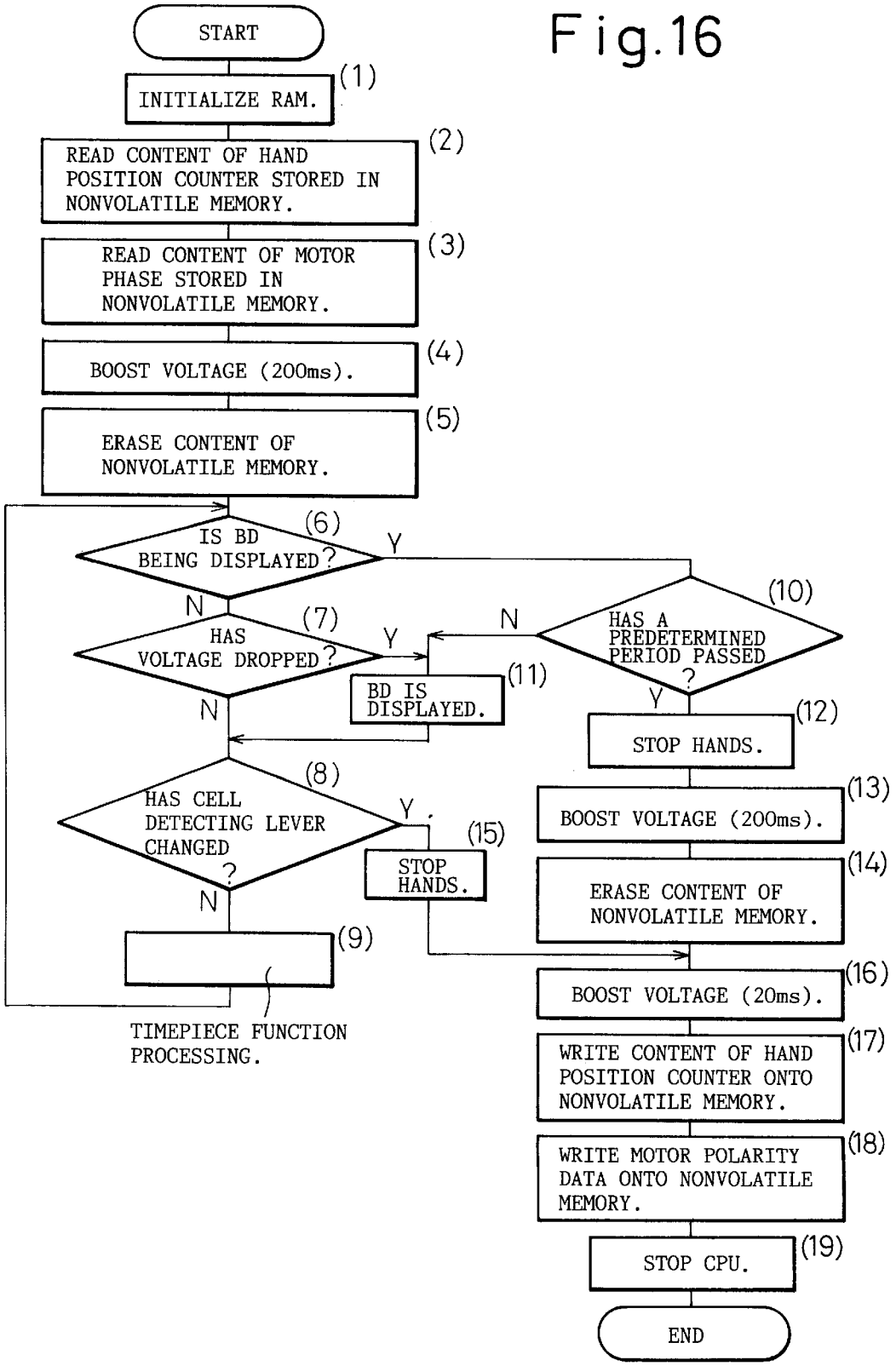
Fig.16
START
INITIALIZE RAM.
(1)
READ CONTENT OF HAND POSITION COUNTER STORED IN NONVOLATILE MEMORY.
(2)
READ CONTENT OF MOTOR PHASE STORED IN NONVOLATILE MEMORY.
(3)
BOOST VOLTAGE (200ms).
(4)
ERASE CONTENT OF NONVOLATILE MEMORY.
(5)
IS BD BEING DISPLAYED?
(6)
Y
N
HAS VOLTAGE DROPPED?
(7)
Y
N
BD IS DISPLAYED.
(11)
HAS A PREDETERMINED PERIOD PASSED?
(10)
N
Y
STOP HANDS.
(12)
HAS CELL DETECTING LEVER CHANGED?
(8)
Y
N
STOP HANDS.
(15)
(9)
TIMEPIECE FUNCTION PROCESSING.
BOOST VOLTAGE (200ms).
(13)
ERASE CONTENT OF NONVOLATILE MEMORY.
(14)
BOOST VOLTAGE (20ms).
(16)
WRITE CONTENT OF HAND POSITION COUNTER ONTO NONVOLATILE MEMORY.
(17)
WRITE MOTOR POLARITY DATA ONTO NONVOLATILE MEMORY.
(18)
STOP CPU.
(19)
END

HAND DISPLAY-TYPE ELECTRONIC TIMEPIECE

This application is a continuation of application Ser. No. 08/167,855, which is a 371 of PCT/JP93/00551, filed Apr. 27, 1992, now abandoned.

TECHNICAL FIELD

The present invention relates to a hand position storage type analog electronic timepiece using a small cell. More specifically, the invention relates to a hand display-type electronic timepiece which is capable of easily bringing an analog-type hand display means and a digital-type hand position data storage means into synchronism with each other.

BACKGROUND ART

Digital electronic timepieces have in many cases been used as so-called functional electronic timepieces as represented by multi-functional timepieces having an alarm function, a chronograph function and similar functions, and electromagnetic wave-corrected timepieces that correct the time upon receiving standard electromagnetic waves, for the reason that digital electronic timepieces constituted by a digital circuit and a digital display device are adapted to processing and displaying the functional data.

Accompanying the recent trend toward developing analog electronic timepieces of the hand position storage type, however, analog electronic timepieces with hands are drawing much attention as multi-functional electronic timepieces.

The constitution of such an analog electronic timepiece has been described in detail in, for example, Japanese Examined Patent Publication (Kokoku) No. 61-38421.

The analog electronic timepiece disclosed therein is of the hand position storage type in which timing data for time is obtained by calculating and storing the time information by using a suitable timing counter and predetermined pulse signals (e.g., pulse signals that are generated one pulse a second) obtained by dividing the frequency of high-frequency signals generated by an oscillator to a suitable period, and the time same as that of the timing counter is displayed in an analog form by rotating the hands using a suitable pulse motor.

In an analog electronic timepiece of this type, the data stored in the timing counter and the data displayed by the hands must be in synchronism at all times. If these data go out of synchronism, a correction process must be carried out by manual operation to bring them back into synchronism.

However, the operation for bringing these into synchronism is so complex and cumbersome that general users find it very difficult to bring the data indicated by the hands and the data of the timing counter into perfect synchronism easily and within a short period of time.

The above-mentioned problem may not be so serious as long as the analog electronic timepiece simply displays the time. In a multi-functional electronic timepiece having special functions such as a function for displaying the passage of time, a stopwatch function, a global time function, a calendar function, etc., in combination, however, if the hands and the timing counter are out of synchronism this presents a problem in that the data for a particular function is not correctly displayed by the hands, and the above-mentioned functions are no longer useful.

In an analog electronic timepiece, the hands and the time data of the timing counter that had been brought in synchronism by a manual operation may become out of synchronism during use for a variety of reasons such as the infiltration of noise that changes the data of the timing counter, failure of the motor to turn despite a drive signal being applied thereto, for some reason, resulting in a delay of the hands. The main cause, however, results from a change in the voltage of the small cell that is used as a power source.

That is, as the voltage of the cell becomes lower than a predetermined value, the timing counter that operates using small amounts of energy continues to operate on a low voltage but the pulse motor that consumes large amounts of energy fails to rotate, i.e., failure to drive the hands results in a loss of synchronism. When the cell is replaced, the content of the timing counter becomes indefinite and synchronism is no longer maintained between the hands and the timing counter. After the cell is replaced, therefore, the crown and the push buttons must be manipulated many times to bring the hands and the data of the timing counter into synchronism with each other.

In the steps of producing analog electronic timepieces, furthermore, the hands must be initially set to be in synchronism requiring considerable precision.

In conventional analog electronic timepieces, therefore, a number of contrivances have heretofore been proposed to bring the hands and the timing counter into synchronism with each other.

Japanese Examined Patent Publication (Kokoku) No. 3-14150 discloses an electronic timepiece having a timing circuit and hands driven by a motor that is energized by the output of a motor drive circuit according to the content of the timing circuit, wherein when they are not in synchronism, the hands are quickly fed quick-feed signals from the motor drive circuit until the counter storing the positions of the hands becomes zero, the counter is held at zero, and the hands are stepped up to the zero position (twelve o'clock position on the dial) which is the same as the content of the counter by using an external switch while the counter is being held at zero.

Japanese Examined Patent Publication (Kokoku) No. 61-38421 discloses a system for keeping synchronism in which a switch is provided for each of the hands, e.g., for each of the hour hand, minute hand and second hand, the switches are turned on to generate pulses every time the hands pass through 0 o'clock, 0 minute, 0 second, and the counted values of the timing counter are reset by the above pulses. Furthermore, Japanese Examined Patent Publication (Kokoku) No. 3-454093 discloses a system in which when the memory of an electronic circuit is going to be lost by the replacement of the cell, the unchanging fixed data that should be preserved is initially stored in a nonvolatile memory and are then brought back to the electronic circuit again after the cell has been replaced.

The above-mentioned systems, however, involve problems. With the system disclosed in, for example, Japanese Examined Patent Publication (Kokoku)) No. 3-14150, a person carrying the timepiece must manipulate it when the cell is replaced, requiring a cumbersome operation for accomplishing correct synchronism, which cannot be accomplished with ease in a short period of time.

The system disclosed in Japanese Examined Patent Publication (Kokoku) No. 61-38421 has an advantage in that the timepiece can be brought into synchronism without requiring the person carrying it to effect the manipulation. This system, however, requires additional switching mechanisms that make the device complex and bulky, which goes against the modern trend toward decreasing the size and thickness, and is disadvantageous in terms of cost. Furthermore, the switches impair reliability depriving the timepiece of commercial value.

The system disclosed in Japanese Examined Patent Publication (Kokoku) No. 3-45409 is concerned with a digital electronic timepiece without hands, wherein the unchanging fixed data such as the data for adjusting the frequency is stored temporarily in a nonvolatile memory. This system cannot be used for storing the data in the nonvolatile memory under the condition where the content of the time counter that is constantly changing is maintained in synchronism with the positions of the hands, which is carried out by the present invention.

The object of the present invention is to provide a hand display-type electronic timepiece which is simply constructed, enables the manufacturer or the user of the analog electronic timepiece to easily and correctly accomplish synchronism between the hands and the timing counter, and does not require the operation for bringing the hands and the timing counter into synchronism when the cell is replaced by the user, eliminating the problems inherent in the aforementioned prior art.

DISCLOSURE OF THE INVENTION

In order to accomplish the above-mentioned object, the present invention basically employs the following technological constitution. That is, a hand display-type electronic timepiece of the present invention is constituted by a cell serving as a power source, a time signal generating means, a motor drive control means, a pulse motor drive means, a pulse motor, hands driven by the pulse motor, and a hand position data generating means which generates hand position data corresponding to the hands, and in which the drive control of the hands is executed according to the data from the hand position data generating means. The invention further comprises a hand drive stop means which stops the hands and the hand position data generating means under the condition in which synchronism is maintained therebetween, a nonvolatile memory for storing hand position data generated from the hand position data generating means, a hand drive data control means which controls at least the nonvolatile memory and the hand drive stop means, and a data storage instruction means which operates the hand drive data control means, wherein in response to a storage instruction signal from the data storage instruction means, the hand drive stop means stops the hands, and the hand drive data control means writes the data stored in the hand position data generating means into the nonvolatile memory.

In the analog electronic timepiece which employs the above-mentioned technological constitution of the present invention, the timing data or the time data and like data are initially stored in the nonvolatile memory under the condition where the positions of the hands are in complete synchronism with the timing counter, i.e., in synchronism with the time data of the hand position counter at a moment when it is confirmed that the potential of the cell which is a power source has dropped below a required voltage level and, particularly, when a user of the electronic timepiece executes the operation for replacing the power source such as the cell. Then, after the power source such as the cell has been replaced, the timing data or the time data stored in the nonvolatile memory are read into the hand position counter and the timing operation is resumed. Therefore, the hands and the hand position counter of the analog electronic timepiece can be started again maintaining the synchronous state of before the power source such as the cell was replaced.

In the analog electronic timepiece of the present invention, therefore, the power source such as the cell can be replaced without the need of carrying out any complex operation for maintaining synchronism between the hands and the hand position counter, i.e., without the need of executing any particular operation for maintaining synchronism or without the need of taking care to maintain synchronism, contributing to greatly improving the commercial value of the analog electronic timepiece.

According to the present invention, furthermore, at a moment when it is confirmed that the potential of the cell has dropped below a necessary voltage level, the hand display-type electronic timepiece, based upon its own judgement, stores the hand position data in the nonvolatile memory under the condition where the positions of the hands are in complete synchronism with the hand position storage data of the hand position data generating means, and then discontinues the function of the operation processing means. Then, after the power source such as the cell has been replaced, the hand position storage data stored in the nonvolatile memory are read into the hand position counter and the timing operation is resumed. Therefore, the hands and the hand position counter of the hand display-type electronic timepiece can be easily started again maintaining the synchronous state that existed before the power source such as the cell was replaced.

BRIEF DESCRIPTION OF DRAWINGS

FIG. 16 is a flow chart illustrating a procedure for operating the hand display-type electronic timepiece shown in FIG. 15 of the present invention;

BEST MODE FOR CARRYING OUT THE INVENTION

Embodiments of the hand display-type electronic timepiece according to the present invention will now be described in detail with reference to the drawings.

Figure 1:
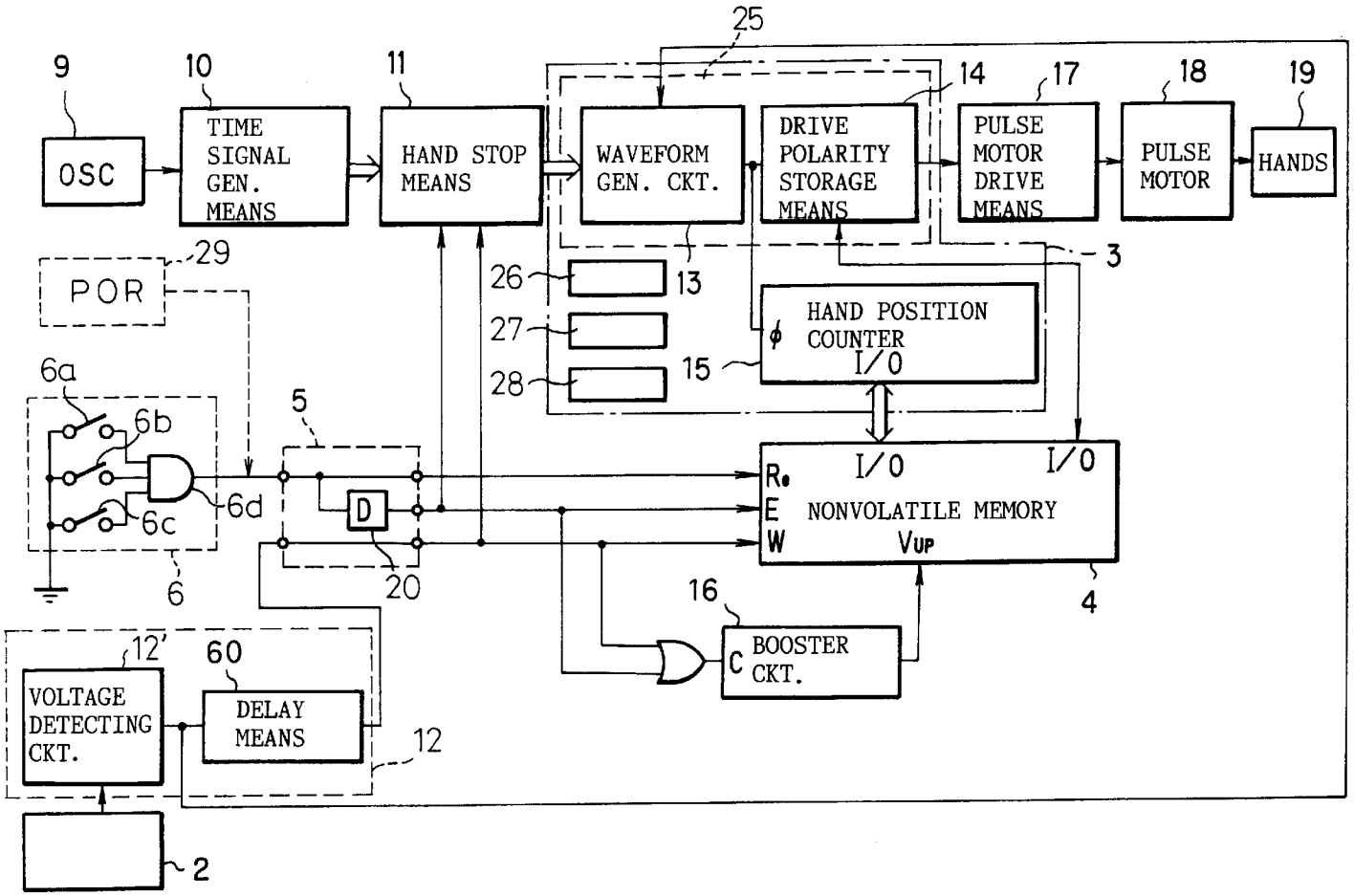
FIG. 1 is a block diagram illustrating the constitution of an embodiment of a hand display-type electronic timepiece according to the present invention.

FIG. 1 is a block diagram illustrating the constitution of a hand position storage-type analog electronic timepiece (hereinafter referred to as an analog electronic timepiece) which is an embodiment of the hand display-type electronic timepiece of the present invention.

The fundamental constitution of FIG. 1 is concerned with a hand display-type electronic timepiece 1 constituted by a cell 2 serving as a power source, a time signal generating means 10, a motor drive control means 25, a pulse motor drive means 17, a pulse motor 18, hands 19 driven by the pulse motor 18, and a hand position data generating means 3 which generates hand position data corresponding to the hands 19, and in which the drive control of the hands is executed according to the data from the hand position data generating means 3. The improvement further comprises a hand drive stop means 11 which stops the hands 19 and the hand position data generating means 3 under the condition in which synchronism is maintained therebetween, a nonvolatile memory 4 for storing hand position data generated from the hand position data generating means 3, a hand drive data control means 5 which controls at least the nonvolatile memory 4 and the hand drive stop means 11, and a data storage instruction means 12 which operates the hand drive data control means 5, wherein in response to a storage instruction signal from the data storage instruction means 12, the hand drive stop means 11 stops the hands 19, and the hand drive data control means 5 writes the data stored in the hand position data generating means 3 into the nonvolatile memory 4.

That is, the present invention is concerned with any analog electronic timepiece which has a function of displaying particular data in an analog form by using hands, and which controls means having an analog display function using digital data by arithmetically processing the particular data and storing them as digital data in a predetermined storage means while at the same time displaying the particular data using the analog display means.

According to the analog electronic timepiece of the present invention, the problem inherent in the prior art that occurs when the power source and, particularly, a small cell used in the analog electronic timepiece, is replaced, is solved by maintaining synchronism between the analog display means and the digital data storage means, i.e., a value of the digital counter. Concretely speaking, the position data of hands in the analog display means and the data of the hand position data generating means 3 inclusive of data of the counter are stored in the nonvolatile memory 4 under the condition in which they are in synchronism with each other just before the voltage of the cell 2 drops so that the operation stops, and at the moment when the cell is replaced, the counter value stored in the nonvolatile memory 4 which is in synchronism with the position data of hands is returned to the counter and the arithmetic processing such as a timing operation is started. Therefore, the arithmetic processing such as a timing operation is resumed while maintaining the condition in which the counter value and the hand data are in perfect synchronism with each other just as before the cell was replaced.

In order to realize the above-mentioned constitution of the present invention, the data storage instruction means 12 is provided, for example, with a power source voltage detecting means 12' which monitors the voltage of the cell 2 at all times, a predetermined output signal is generated when the voltage of the cell 2 that has dropped below a predetermined voltage level is detected by the power source voltage detecting means 12', and the hand position data are written into the nonvolatile memory 4 in response to the above output signal and, at the same time, the hands 19 are stopped.

After the above operation is finished, the function of the arithmetic processing means that is controlling a circuit which is executing the timing operation processing means of the analog electronic timepiece 1 is stopped. Or, in other words, the analog electronic timepiece 1 itself stores in the nonvolatile memory 4 the timing data of hands 19 and the digital timing data of the hand position data generating means 3 maintaining synchronism with each other, and then goes into "hibernation".

The constitution of an analog electronic timepiece which is a hand display-type electronic timepiece of the invention will now be described in further detail in reference to FIGS. 1 and 2.

As shown in FIG. 1, the analog electronic timepiece 1 according to the present invention is provided with a reference pulse signal generating means (OSC) 9, a time signal generating means 10 which is connected to the reference pulse signal generating means (OSC) 9 and has a suitable frequency-dividing function, and a hand drive stop means 11 which receives an output signal from the time signal generating means 10 and determines whether the output signal of the time signal generating means 10 is to be fed to the hand position data generating means 3 or not in response to a control signal from the hand drive data control circuit 5.

That is, when the hand drive stop means 11 is in the OFF condition, the output signal of the time signal generating means 10 is transmitted to a pulse motor 18 which drives the hands 19 via the hand position data generating means 3 to thereby drive the hands 19. When the hand drive stop means 11 is in the ON condition, on the other hand, no signal is input to the hand position data generating means 3 from the time signal generating means 10 and thereby the pulse motor 18 stops and the hands 19 also stop.

At the same time, no signal is input to a hand position counter 15 in the hand position data generating means 3, whereby the timing data displayed by the hands 19 and the timing data indicated by the hand position counter 15 are stopped from maintaining synchronism.

In the present invention, furthermore, the hand drive data control circuit 5 works to stop the hands 19 by driving the hand drive stop means 11 in response to a delay signal output from a delay means 60 that operates in response to a detect signal output from the voltage detecting circuit 12' in the data storage instruction means 12.

In the above-mentioned embodiment of the present invention, the hand position data generating means 3 further includes a pulse motor drive control means 25 constituted by a waveform generating means 13 and a drive polarity storage means 14 which changes the output signal from the waveform generating means 13 to a motor drive signal of a different polarity and stores the polarity thereof.

According to the present invention, the waveform generating means 13 has a function of generating, for example, a drive pulse of a correct waveform maintaining a period of one second from a predetermined output signal generated from the time signal generating means 10, and the drive polarity storage means 14 has a function of outputting the drive pulses by alternatingly changing the polarities thereof and of storing the polarities thereof, which are basically known constitutions as disclosed in, for example, Japanese Examined Patent Publication (Kokoku) No. 63-11880.

Moreover, the hand position data generating means 3 of the present invention is provided with a timing counter 26, a function counter 28, a comparator means 27 and similar means which have been widely known to carry out a variety of functional operations and a time correcting operation as will be described later in detail.

That is, in the analog electronic timepiece of the present invention, the hands 19 are usually driven by using a two-pole pulse motor and one coil. Therefore, the pulse motor 18 must be supplied with pulses the polarities of which change alternatingly.

The waveform generating means 13 may have a function of generating such waveforms that consecutively produce, for example, two pulses maintaining an interval of two seconds, in response to data from the power source voltage detecting means 12' in the data storage instruction means 12 that detects the voltage in case the voltage of the power source 2 such as a cell has dropped below a predetermined threshold value. When the voltage of the power source drops below a predetermined level, therefore, the hands 19 are consecutively driven twice within a short period of time, brought to a standstill for two seconds, and consecutively driven twice within a short period of time, letting the user of the analog electronic timepiece easily confirm the drop of voltage of the cell.

According to the present invention, furthermore, the hand position data generating means 3 is provided with the hand position counter 15 that stores the timing data displayed by the hands 19.

The hand position counter 15 is connected between the waveform generating means 13 and the drive polarity storage means 14, and counts and stores the drive pulses that are output from the waveform generating means 13 to the pulse motor drive means 17 to drive the hands 19.

The drive polarity storage means 14 is connected to a pulse motor drive means 17 which drives the hands 19, stores the drive pulses output from the waveform generating means 13 while successively inverting the polarities thereof, and permits the motor drive means 17 to be driven by the alternating drive pulses.

Thus, the waveform generating means 13 and the drive polarity memory means 14 constitute the motor drive control means 25 which controls the alternating drive pulses supplied to the motor drive means 17.

According to the present invention as will be obvious from the above-mentioned constitution, the hand drive data control circuit 5 controls the hand drive stop means 11 and the hand position data generating means 3 in an interlocked manner. Concretely speaking, as the hand drive data control circuit 5 operates, the hand drive stop means 11 operates to block the supply of pulse signals from the time signal generating means 10 to the motor drive control means 25 in the control circuit 3, whereby the hand position counter 15 stops the counting operation and stores the counter value at that moment.

The nonvolatile memory 4 used in the present invention does not have any particular limitation on its constitution and may be any widely known one as disclosed in Japanese Examined Patent Publication (Kokoku) No. 3-45409 mentioned earlier.

According to the present invention, furthermore, position data of the hands 19 is stored in the nonvolatile memory 4 when the cell is to be replaced, and is taken back out after the cell is renewed in order to bring the timing data of the hands 19 and the timing data of the hand position counter 15 into synchronism with each other when the timing operation is started again. Strictly speaking, however, temporary storage only of the data of the hand position counter 15 may not be sufficient to bring the timing data of the hands 19 and the timing data of the hand position counter 15 into synchronism with each other when the timing operation is started again after the cell is replaced.

This is because, when the hand drive stop means 11 operates causing the hands 19 and the hand position counter 15 to come to a halt, the drive polarity storage means 14 at the same time also comes to a halt. When the timing operation is resumed under this condition, therefore, synchronism is perfectly maintained between the hands 19 and the hand position counter 15 since the memory of the drive polarity storage means 14 has been preserved. When the cell is removed to be replaced by a new one, however, the memory of the drive polarity storage means 14 is lost, and it becomes uncertain which polarity is to be stored when a new cell is loaded. Therefore, when the polarity stored in the drive polarity storage means 14 after the cell is replaced happens to be the same as the polarity stored before the cell was replaced, synchronism is maintained between the hands 19 and the hand position counter 15 when the timing operation is resumed. When the polarity stored in the drive polarity storage means 14 happens to be opposite to the polarity before the cell was replaced, however, the first hand drive pulse signal that is fed to the hand position data generating means 3 passing through the hand drive stop means 11 when the timing operation is resumed, counts up the content of the hand position counter 15 by one. Here, however, the drive polarity storage means 14 is supplied with the motor drive pulse having the same polarity as that of the motor drive pulse that was fed last before the cell was replaced. Accordingly, the pulse motor 18 that is driven by the motor drive pulses of alternatingly changing polarities, is not permitted to rotate and the hands 19 remain still. The hands 19 and the hand position counter 15 are brought into synchronism after the hand drive pulse signal of the second time is fed thereto. At this moment, however, the timing data of the hands 19 is delayed by one step behind the timing data of the hand position counter 15.

That is, with the system in which the data of the hand position counter 15 is only temporarily stored, the hands 19 are delayed by one step (by one second) at a probability of 50%. The delay of one step does not seriously affect the function of the timepiece and, additionally, it occurs with a probability of 50%, which may not be much of a problem.

Perfect synchronism which is not affected by probability, however, is required for those timepieces in which perfect synchronism must be maintained between the hands 19 and the hand position counter 15 such as electromagnetic wave-corrected electronic timepieces and electronic timepieces with functions of higher performance.

In the embodiment of the invention, therefore, the data of the hand position counter 15 as well as the data of the drive polarity storage means 14 are initially stored in the non-volatile memory 4 and are taken back out again after the cell is replaced, in order to guarantee the operations of the hands 19 and the hand position counter 15 being in perfect synchronism with each other.

The non-volatile memory 4 is provided with a booster means 16. When predetermined data are to be written into the nonvolatile memory 4, the booster means 16 must be boosted to a predetermined voltage. To write new data into the nonvolatile memory 4, the data remaining in the non-volatile memory 4 must be erased. The erasing operation is executed by the booster means 16.

The hand drive data control circuit 5 according to the present invention is connected to a switch block consisting of a plurality of switches that constitute the data read instruction means 6 which is provided separately from the data storage instruction means 12, and which works to read the data stored in the nonvolatile memory 4 into the hand position counter 15 again. The data read instruction means 6 is provided with a plurality of switches 6*a*, 6*b*, 6*c* for correcting the analog electronic timepiece and for controlling the functions, and an AND gate 6*d* for generating AND outputs of the plurality of switches 6*a*, 6*b*, 6*c*.

That is, upon depressing the predetermined switches, an instruction is output to store the data of the hand position counter 15 in the nonvolatile memory 4.

The hand drive data control circuit 5 contains a suitable delay circuit 20, and its output is connected to the hand drive stop means 11, the nonvolatile memory 4 and the booster means 16.

In the present invention, in particular, a detect signal of the power source voltage detecting means 12' which indicates that the power source voltage dropped below a predetermined threshold value, is fed to the hand drive stop means 11 via the hand drive data control circuit 5 and is further fed, as a write signal, to a write signal terminal W of the nonvolatile memory 4 and to the booster means 16.

Therefore, as the power source voltage detecting circuit 12' provided in the data storage instruction means 12 detects the cell voltage that has dropped below a predetermined level and as a predetermined period of time passes that is determined by the delay means 60 in the data memory instruction means 12 after the detect signal is output, the hand drive stop means 11 operates so that no output signal is fed from the time signal generating means 10 to the hand position data generating means 3, and whereby the hand position counter 15 stops and the hands 19 also stop.

At the same time, the nonvolatile memory 4 receives a write signal from the hand drive data control circuit 5 which reads the data stored in the hand position counter 15 and the polarity data stored in the drive polarity storage means 14, and then writes these data in the nonvolatile memory 4.

At this moment, the booster means 16 is driven simultaneously, and the nonvolatile memory 4 is supplied with a high voltage boosted to a voltage level necessary for writing.

That is, in the present invention, after a predetermined delay time has passed that is determined by the delay means 60 in response to the data of the power source voltage detecting circuit 12', the hand drive stop means 11 is operated, and the data of the hand position counter 15 and of the drive polarity storage means 14 are written into the nonvolatile memory 4.

According to the present invention, the analog electronic timepiece is designed to operate properly for at least about ten days even when the voltage of the cell has dropped below a predetermined threshold value. Therefore, after the power source voltage detecting circuit 12' has detected a predetermined voltage drop, a suitable period of time is specified ranging from about two days to about eight days, and the delay is given for this period of time.

According to the present invention as described above, after the above-mentioned predetermined delay time has passed, the timing data and polarity data are stored in the nonvolatile memory 4 while maintaining synchronism between the timing data indicated by the hands 19 and the timing data of the hand position counter 15 in the hand position data generating means 3 and maintaining synchronism between the polarity of the drive polarity storage means 14 and the polarity of the pulse motor 18. After the renewal of the cell is finished, the timing data and polarity data stored in the nonvolatile memory 4 are read onto the hand position data generating means 3 to resume the timing operation. Thus, the timing operation is started again under the condition in which the data of the hands 19 and the data of the hand position counter 15 are maintained in perfect synchronism with each other.

That is, in the present invention, when the renewal of the cell is finished, the hand drive data control circuit 5 reads the data stored in the nonvolatile memory 4 onto the hand position data generating means 3 in response to a read signal output from the AND gate 6*d* in the switch block 6 which indicates that the analog electronic timepiece is loaded with a new cell.

In this embodiment, the read signal which indicates that the analog electronic timepiece is loaded with a new cell is output from the AND gate 6*d* when the user of the analog electronic timepiece intentionally establishes a condition which does not usually exist by simultaneously manipulating three switches 6*a*, 6*b* and 6*c* which constitute the data read instruction means 6 that is provided separately from the data storage instruction means 12 after the cell is replaced.

It is also possible to use a power-on pulse that is generated when the cell is loaded by providing a power-on reset means 29 as indicated by a dotted line in FIG. 1.

It is further possible to employ any constitution which generates a predetermined output signal by detecting the condition where the back of the analog electronic timepiece is closed or where the cell-pressing plate has returned to the initial state.

That is, in response to the read signal that indicates that the analog electronic timepiece is loaded with a new cell 2, the hand drive data control circuit 5 reads the data stored in the nonvolatile memory 4 into the hand position counter 15 and the drive polarity storage means 14 in the hand position data generating means 3, turns the hand drive stop means 11 off after the predetermined delay time set by the delay circuit 20 has passed to start the operation of the hands 19, and energizes the booster circuit 16 to erase the data in the nonvolatile memory 4.

In the present invention, the predetermined data stored in the nonvolatile memory 4 are directly read out in response to the output signal of the switch block 6 since there is no particular need to operate the booster means 16. To stabilize the reading operation, however, a delay circuit 20 is provided, and the hand drive stop means 11 is returned to the OFF condition after a predetermined delay time from when the data are read out in order to erase the nonvolatile memory 4. The read signal indicating the renewal of the cell that is input to the hand drive data control circuit 5, is input to the read terminal Re of the nonvolatile memory 4, whereby the timing data and the polarity data stored in the nonvolatile memory 4 are read onto the hand position counter 15 and into the drive polarity storage means 14 in the hand position data generating means 3 and are stored therein.

Then, after the passage of a predetermined delay time determined by the delay means 20 for stabilizing the reading operation, the OFF signal is output to the hand drive stop means 11, whereby the hand drive stop means 11 is turned off. Therefore, the output signal of the time signal generating means 10 is fed to the pulse motor drive means 17 via the pulse motor control circuit 25 in the hand position data generating means 3, and the hands 19 are driven with the timing data read into the hand position counter 15 as start data.

Up to this step, the hands 19 stop moving at a moment when the hand drive stop means 11 is turned on and remain at the stopped position. By starting the driving simultaneously with the timing data stored in the hand position counter 15 and the polarity data stored in the drive polarity storage means 14, therefore, the timing processing is resumed under the condition in which they are in perfect synchronism with each other.

The present invention stores the polarity of a drive pulse fed to the pulse motor drive means 17. When the pulse motor drive means 17 is driven, therefore, reference is made to the polarity data to judge whether the drive pulse of positive polarity or the drive pulse of negative polarity is to be fed first, and the pulse of a proper polarity is fed to maintain the above-mentioned perfect synchronism.

At this moment, furthermore, the timing data stored in the nonvolatile memory 4 have all been read onto the hand position counter 15. Therefore, a signal from the delay circuit 20 is input as an erase signal to an erase terminal E of the nonvolatile memory 4 to erase all of the contents of the nonvolatile memory 4.

According to the present invention, the operation for erasing the nonvolatile memory 4 is executed after the passage of the delay time that is set by the delay circuit 20 in the hand drive data control circuit 5. The erasing operation may be executed while the analog electronic timepiece is being used under ordinary conditions. In this case, the hand drive data control circuit 5 may execute the operation for erasing the content of the nonvolatile memory after the passage of predetermined periods of time such as at 0 o'clock, 0 minute, 0 second every day or at 0 o'clock, 0 minute, 0 second the first day of every month.

Figure 3:
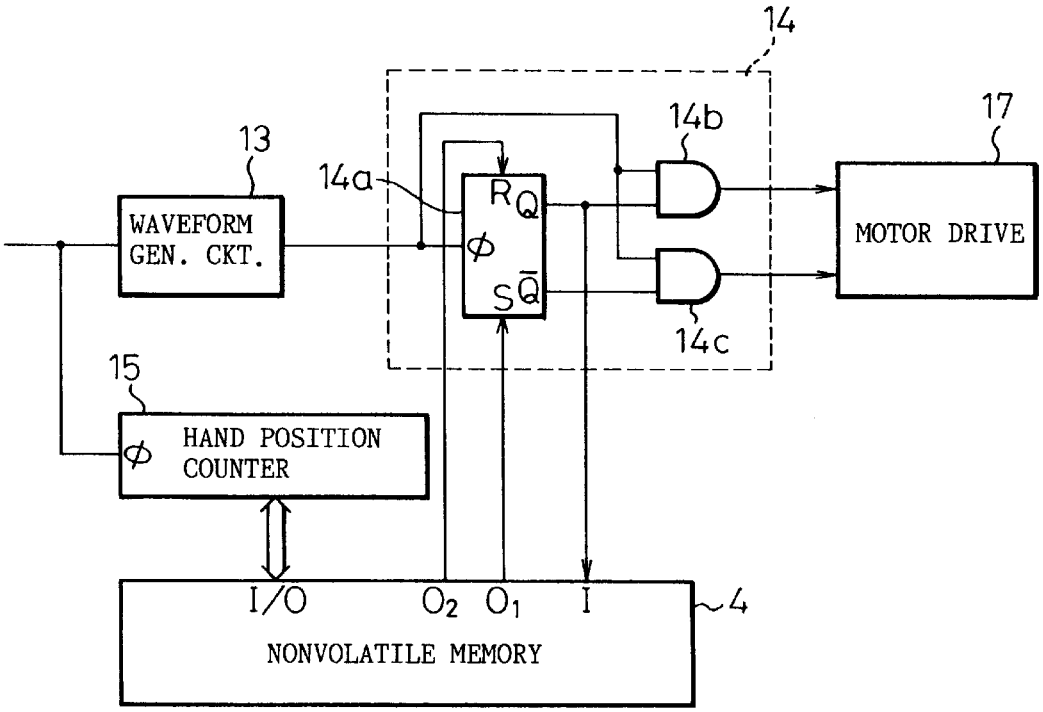
FIG. 3 is a block diagram illustrating a circuit for detecting the polarity of a motor drive pulse used for the hand display-type electronic timepiece according to the present invention.

FIG. 3 is a partial block diagram for explaining the concrete constitution of the drive polarity storage means 14 in FIG. 1 and for explaining the operation for writing the polarity data into and reading the polarity data from the nonvolatile memory 4. That is, the drive polarity storage means 14 is basically constituted by a flip-flop 14*a* (hereinafter abbreviated as FF) which is alternatingly inverted in response to the drive pulse fed from the waveform generating means 13 to switch the polarity of the drive pulse, and two AND gates 14*b* and 14*c* of which the terminals on one side are connected to the output Q and/output $\overline{Q}$ of the FF14*a* and of which the terminals on the other side receive a drive pulse, like the one disclosed in the aforementioned Japanese Examined Patent Publication (Kokoku) No. 63-11880. However, what makes a difference from the prior art circuit is that the FF14*a* has a set terminal S and a reset terminal R.

The output Q of the FF14*a* is connected to the input terminal I of the nonvolatile memory 4, and the set terminal S and the reset terminal R are connected to the output terminals $O_1$ and $O_2$ of the nonvolatile memory 4, respectively.

During the writing operation, the drive polarity storage means 14 which is constituted as described above sends the polarity data stored in the FF14*a* to an input terminal I of the nonvolatile memory 4 from the output Q to store the polarity data therein. During the reading operation, the drive polarity storage means 14 sends a signal from the output Q to an output terminal $O_1$ when the polarity data is "H" to set the FF14*a*. When the polarity data is "L", the signal is sent to the output terminal $O_2$ to reset the FF14*a*, so that the drive polarity storage means 14 is returned to the state of before the cell was replaced.

Figure 4:
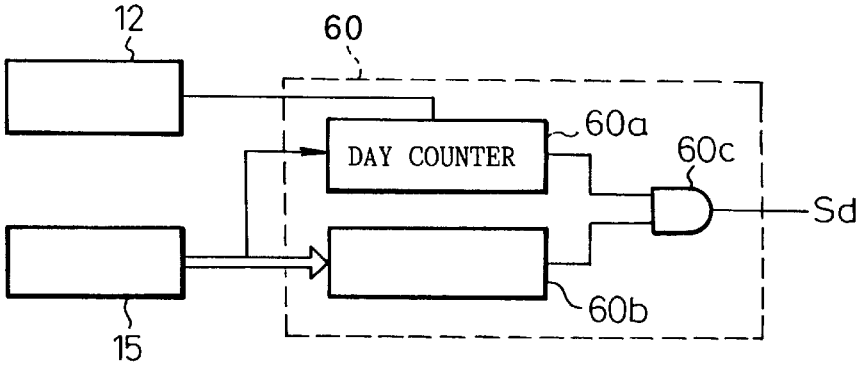
FIG. 4 is a diagram illustrating the constitution of a delay means used in the hand display-type electronic timepiece according to the present invention.

FIG. 4 is a block diagram illustrating an embodiment of the delay means 60 shown in FIG. 1. The delay means 60 is constituted by a day counter 60*a* which starts operating in response to a detect signal from the power source voltage detecting circuit 12' and counts the carry signals that are output from the hand position counter 15 every after twelve hours, a particular time detecting means 60*b* which detects a particular time such as 0 o'clock, 0 minute, 0 second in response to an output signal of the hand position counter 15, and an AND gate 60*c* which detects an AND output of the particular time detecting means 60*b* and the day counter 60*a* and outputs a delay signal Sd. That is, in the thus constituted delay means 60 of this embodiment, the day counter 60*a* counts six days after having received a detect signal from the power source voltage detecting circuit 12', and a delay signal Sd is output at a moment when the particular time detecting means 60*b* has detected 0 o'clock, 0 minute, 0 second. Therefore, the analog electronic timepiece stores the data and comes to a halt at 0 o'clock, 0 minute, 0 second after six days from when the voltage drop was detected.

By setting a time at which the analog electronic timepiece comes to a halt, the user is allowed to know that the analog electronic timepiece is in a storing operation, and the amount of time data that are to be stored can be reduced.

Figure 2:
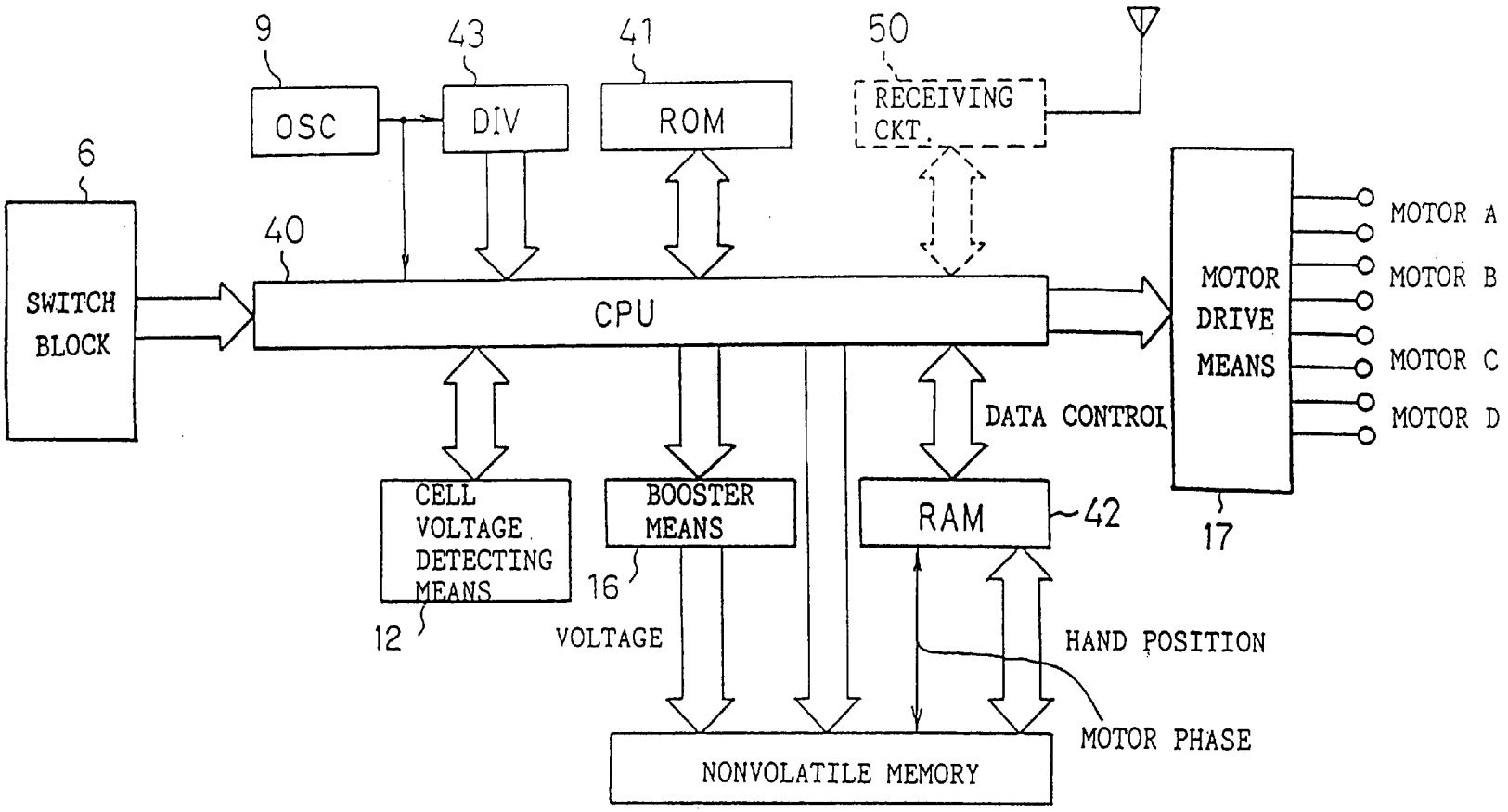
FIG. 2 is a block diagram illustrating an embodiment of a control system in the hand display-type electronic timepiece according to the present invention.

FIG. 2 is a block diagram illustrating the analog electronic timepiece of the present invention which is practically constituted by using a microcomputer, wherein the same constituent elements as those shown in FIG. 1 are denoted by the same reference numerals but are not illustrated here again. As is widely known, the basic constitution of FIG. 2 comprises a CPU 40 which arithmetically processes and controls each portion, a ROM 41 which stores programs of control operations, and a RAM 42 which stores a variety of data.

The CPU 40, ROM 41 and RAM 42 constitute the hand position data generating means 3, hand drive data control means 5, hand drive stop means 11, and delay means 60 that are shown in FIG. 1. A frequency-dividing means 43 of FIG. 2 has a function of the time signal generating means 10 of FIG. 1 and a function for feeding clock signals to the circuits.

In order to execute the above-mentioned functions according to the present invention, it is desired that the hand position data generating means 3 includes, for example, at least the timing counter 26 and the hand position counter 15.

Described below is the reason why the hand position data generating means 3 according to the present invention must be provided with the timing counter 26 and the hand position counter 15.

That is, in the multi-functional type electronic timepiece, what data is displayed by the analog hands varies depending upon the mode that is set.

For this purpose, the analog hands display positions that correspond to data of the hand position counter 15 in accordance with the mode that has been set. A counter, however, is necessary for correctly counting the time irrespective of the display of each of the modes.

Functions and operations of the timing counter and the hand position counter in the multi-functional timepiece according to the present invention will be described below with reference to FIGS. 5 and 6.

Figure 5:
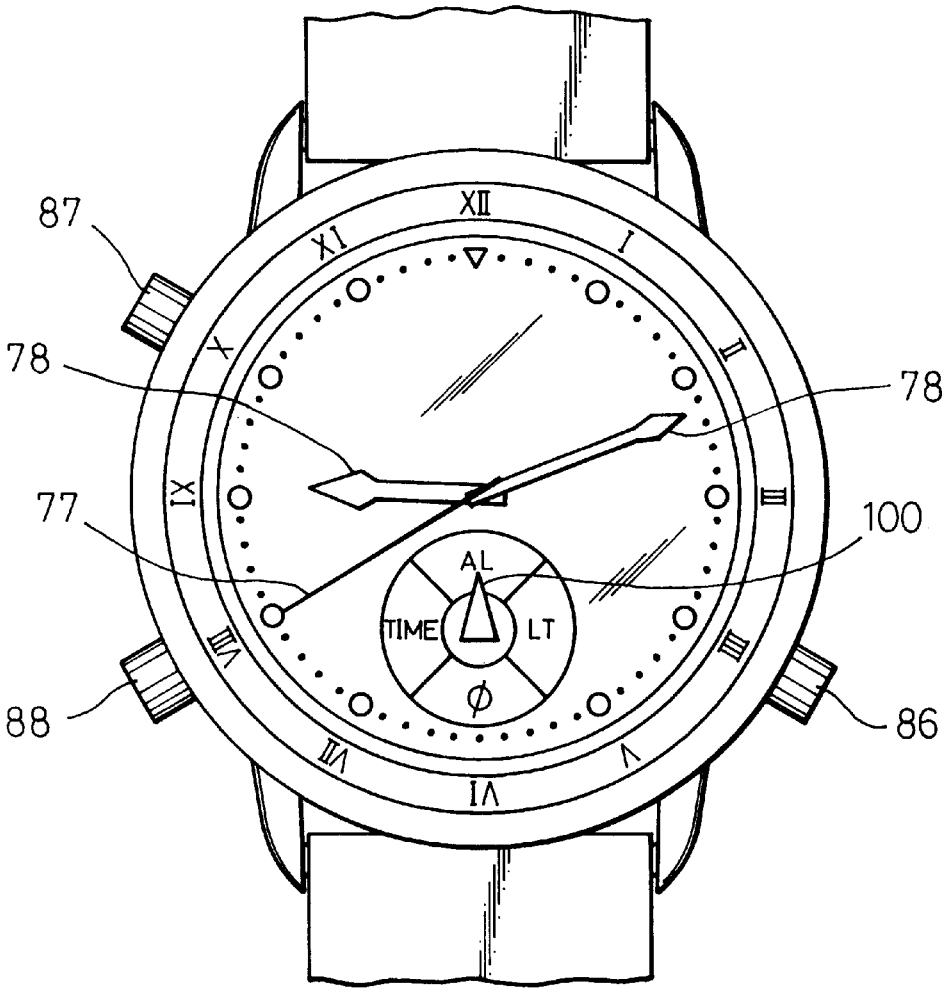
FIG. 5 is a diagram illustrating the constitution of appearance of the hand display-type electronic timepiece according to the present invention.
Figures 6, 6A, 6B:
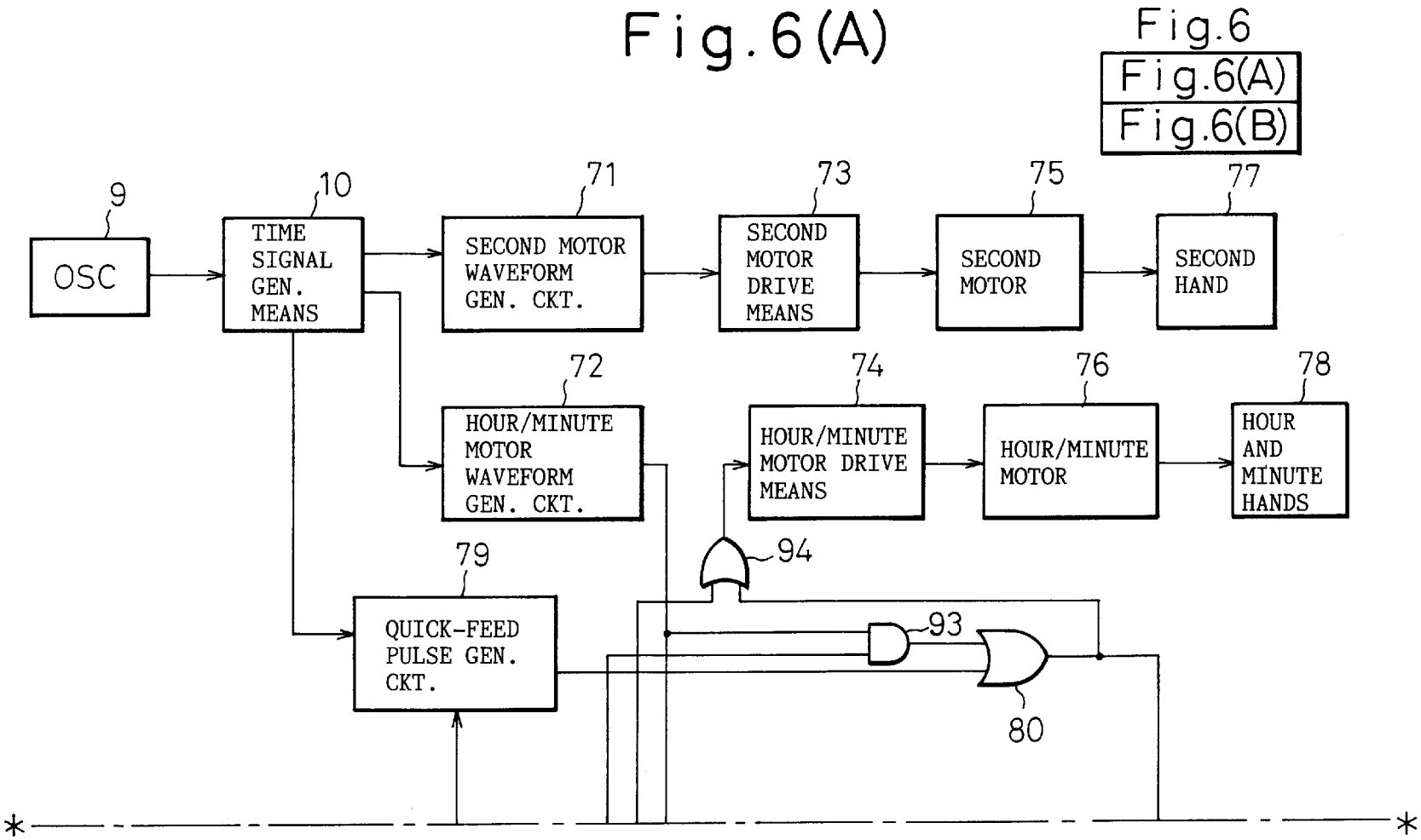
FIGS. 6(A) and 6(B) are block diagrams illustrating a relationship between a hand position counter and a multifunctional counter including a timing counter in the hand display-type electronic timepiece according to the present invention.
Figure 6B:
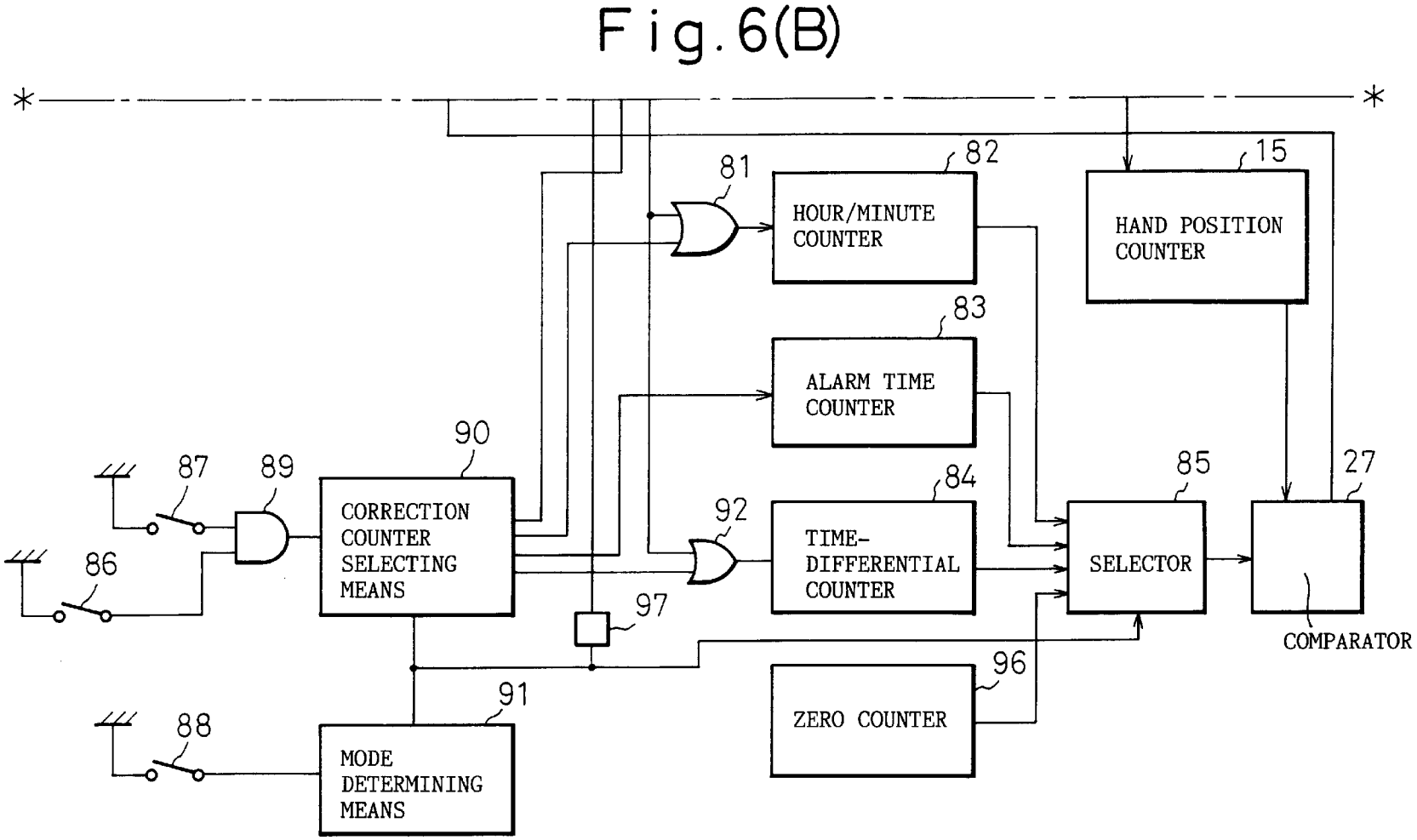

FIG. 5 is a diagram illustrating the appearance of the multi-functioned timepiece according to the present invention, wherein reference numeral 77 denotes a second hand, 78 an hour hand, 86 a crown switch which, when pulled out by one step, changes the mode that is being selected to a correction state, 87 a correction switch, 88 a mode selecting switch, and reference numeral 100 denotes a mode hand that indicates the mode. FIGS. 6(A) and 6(B) are block diagrams of a circuit illustrating a multi-functional timepiece according to the present invention, wherein reference numeral 9 denotes an oscillation circuit, 10 a time signal generating means, 71 a second waveform generating circuit that generates a signal for driving a second motor, 72 an hour/minute waveform generating circuit that generates a signal for driving an hour/minute motor, 73 a second motor drive means, 74 an hour/minute motor drive means, 75 a second motor, 76 an hour/minute motor, 15 the hand position counter which is linked to hour and minute hands to hold the hand positions, and reference numeral 79 denotes a quick-feed pulse generating circuit that generates quick-feed pulses in response to signals from the time signal generating means 10.

Reference numeral 91 denotes a mode determining means which outputs a mode signal based upon a mode selecting switch, 97 a pulse validating means which receives a signal from the mode determining means 91 and outputs "1" in the present time mode and in the time-differential mode only, 89 denotes an AND gate that receives signals from the crown switch 86 and the correction switch 87, reference numeral 90 denotes a correction counter selecting means which selectively outputs the signal of the correction switch 87 fed via the AND gate 89 in response to a signal from the mode determining means 91, reference numeral 82 denotes an hour/minute counter which counts the present time, 83 an alarm time counter which holds an alarm time, 84 a time-differential counter which counts the time in an area where there exists a time difference, 96 a zero counter which holds zero data at all times, 85 a selector which selects any one of these counters and outputs counter data thereof, 27 a comparator means which compares the counter data sent via the selector 85 with the data of the hand position counter 15 and outputs an operation signal to the quick-feed pulse generating circuit 79 when they are not in agreement, 81 an OR gate which outputs a time signal from the hour/minute waveform generating circuit 72 to the hour/minute counter 82 or outputs a correction signal from the correction switch 87 to the hour/minute counter 82, reference numeral 92 denotes an OR gate which outputs a time signal from the hour/minute waveform generating circuit 72 to the time-differential counter 84 or outputs a correction signal from the correction switch 87 to the time-differential counter 84, reference numeral 93 denotes an AND gate which permits the passage of a time signal from the hour/minute waveform generating circuit 72 in response to the output of the pulse validating means 97 in the time mode and in the time-differential mode only, 80 an OR gate which outputs the output from the AND gate 93 or the quick-feed signal from the quick-feed pulse generating circuit 79 to the hour/minute motor drive means 74 via the OR gate 94 and to the hand position counter 15, and reference numeral 94 denotes an OR gate which outputs the hour/minute hands correction signal from the correction counter selecting means 90 or the signal from the OR gate 80 to the hour/minute motor drive means 74.

Described below is the operation of the multi-functional timepiece. In this multi-functional timepiece, the hour and minute hands 78 display the present time, alarm time or time differential depending upon the mode. Therefore, the internal hand position counter 15 and the hour and minute hands 78 must be brought into agreement at the 0 position. When the timepiece is brought to the 0 position mode by operating the mode selecting switch 88, the selector 85 outputs the data of the 0 counter 96 to the comparator means 27 in response to a signal from the mode determining means 91. Then, the comparator means 27 operates the quick-feed pulse generating circuit 79 until the hand position counter 15 becomes 0. Therefore, the hour and minute hands 78 are quickly fed and come to a halt at 0 o'clock, 0 minute when they are in agreement with the 0 position. At this moment, the AND gate 93 is invalidated due to the output of the pulse validating means 97, and the output of the hour/minute waveform generating circuit 72 is sent to the hour/minute counter 82 only but is not sent to the hand position counter 15. Then, the hour/minute counter 82 counts the present time with the hand position counter 15 being held at 0. Here, if the hour and minute hands 78 are not in agreement with the 0 position, the user pulls the crown switch 86 by one step to turn it on to establish the 0 position correct state. Here, if the correction switch 87 is operated, the correction signal is output to the hour/minute motor drive means 94 via the correction counter selecting means 90 and the OR gate 94 to thereby drive the hour and minute hands 78. Thus, the hand position counter 15 and the hour and minute hands 78 can be brought into agreement at the 0 position.

Next, the mode selecting switch 88 is operated and the timepiece is brought to the present time mode. Then, the selector 85 outputs the counter information of the hour/minute counter 82 to the comparator means 27 in response to the output from the mode determining means 91. Here, the comparator means 27 detects the non-coincidence between the hand position counter 15 and the hour/minute counter 82 and operates the quick-feed pulse generating circuit 79 until the hand position counter 15 comes into agreement with the hour/minute counter 82. Then, the hand position counter 15 and the hour and minute hands 78 are quickly fed simultaneously in response to quick-feed signals from the quick-feed pulse generating circuit 79, whereby the hour and minute hands 78 come into agreement with the hour/minute counter 82 with the hand position counter 15 as a mediator. Therefore, the user is allowed to know the content of the hour/minute counter 82, i.e., the present time. Here, if the hour and minute hands 78 are not displaying the correct time, the user pulls the crown switch 86 by one step to turn it on to thereby establish the present time correction state. When the correction switch 87 is operated, a correction signal is output via the collection counter selecting means 90 and the OR gate 81 to correct the hour/minute counter 82. Then, the comparator means 27 detects a difference between the data of the hour/minute counter 82 and the data of the hand position counter 15 and operates the quick-feed pulse generating circuit 79, such that the hour/minute counter 82, hand position counter 15 and hour/minute hands 78 are brought into agreement at all times. Thus, the user is allowed to set the hour and minute hands 78 to a correct time. In the case of the present time mode, furthermore, the pulse validating means 97 validates the AND gate 93, whereby the output of the hour/minute waveform generating circuit 72 is output simultaneously to the hour/minute counter 82, hand position counter 15 and hour/minute motor drive means 74, and the hour and minute hands 78 are driven together with the hand position counter 15 being linked to the hour/minute counter 82.

Next, the mode selecting switch 88 is operated to bring the timepiece into the alarm time mode. Then, based on the output from the mode determining means 91, the selector 85 outputs the counter data of the alarm time counter 83 to the comparator means 27. As a result, the hour and minute hands 78 undergo the same operation as in the case of the present time mode to display the alarm time. In this case, however, the pulse validating means 97 is invalidating the AND gate 93, and the hour/minute counter 82 continues to count the present time. However, the hour/minute hands 78 and the hand position counter 15 which are not receiving output from the hour/minute waveform generating circuit 72 remain stopped while displaying the alarm time. Here, if the mode is shifted again to the present time mode, the hour and minute hands 78 and the hand position counter 15 operate in the same manner as described above and are brought into agreement with the content of the hour/minute counter 82. Even when the mode is thus shifted, the hour/minute counter 82 only continues to count the present time independently of others. When the mode is shifted to the present time mode, therefore, the hour and minute hands 78 display the present time via the hand position counter 15. The operation for correcting the alarm time is the same as the above-mentioned operation for correcting the present time and is not described here again.

Next, the mode selecting switch 88 is operated to place the timepiece in the time-differential mode. Then, the selector 85 outputs the counter information of the time-differential counter 84 to the comparator means 27 in response to the output from the mode determining means 91. At this moment, the pulse validating means 97 validates the AND gate 93 and, hence, the output of the hour/minute motor waveform generating circuit 72 is sent to the time-differential counter 84, hand position counter 15 and hour/minute motor drive means 74, and the hour and minute hands 78 are linked to the time-differential counter 84 together with the hand position counter 15. Here, the operation for correcting the time differential is the same as the aforementioned operation for correcting the present time and is not described here again.

In the present invention, furthermore, it is desired that the hand drive data control means 5 is so constituted as to control the hand position counter 15 and the motor drive control means 25 in a manner in which they are linked to each other.

In the present invention as exemplified above, furthermore, it is desired that the motor drive means 17 includes the waveform generating means 13 and the polarity storage means 14 which changes the output signals from the waveform generating means 13 into motor drive signals of different polarities and stores the polarities.

Into the nonvolatile memory 4 are written data of the hand position counter 15, as well as the hand position data of the hand position counter 15 and the polarity data of the drive polarity storage means 14.

When the cell voltage that has dropped below a predetermined level is automatically detected or when a suitable external switching means is depressed, the data storage instruction means 12 outputs an instruction that the data of the hand position counter 15 is to be written into the nonvolatile memory 4. When a predetermined storage instruction signal is output from the data storage instruction means 12, the hand drive data control means 5 operates to drive the hand drive stop means 11, whereby the hands are brought to a halt. Then, the hand position data in the hand position data generating means 3 and the polarity data of the drive polarity storage means 14 are written into the nonvolatile memory 4, and the functions of the hand display-type electronic timepiece are all brought into halt.

It is, on the other hand, desired that the hand drive stop means 11 is provided between the time signal generating means 10 and the hand position data generating means 3.

According to the present invention as described above, the analog electronic timepiece employs the aforementioned technical constitution. At a moment when the power source voltage that has dropped below a required voltage level is detected, therefore, the analog electronic timepiece brings the counting operation of the hand position data generating means and the operation of the hands to a halt under the condition in which they are in synchronism with each other based upon its own judgement, stores the timing data stored in the hand position data generating means in the nonvolatile memory as hand position data, and then brings the functions of all circuits inclusive of the arithmetic processing means to a halt.

After the replacement of the cell is finished, the timing data stored in the nonvolatile memory are restored by being read into the hand position data generating means 3 either automatically or by manipulating a suitable switch provided in the data read instruction means 6, and the counting operation of the hand position data generating means is then resumed under the condition in which it is brought into synchronism with the operation of the hands. Thus, the synchronism between the hands and the timing data in the analog electronic timepiece is prevented from being lost by the renewal of the cell. According to the present invention, furthermore, polarity data of a motor drive pulse stored in the drive polarity storage means is stored in the nonvolatile memory together with the timing data at a moment when the voltage drop is confirmed, and is returned to the drive polarity storage means when the renewal of the cell is finished so that the polarity of the motor drive pulse is set to the state that existed before the cell was replaced. This makes it possible to even prevent a pulse error that stems from a difference in the polarity of the drive pulse at the time when the timing operation is resumed, and hence to guarantee the operations of the timing data and the hand positions maintaining perfect synchronism therebetween.

When the analog electronic timepiece of the present invention is used as a multi-functional timepiece, therefore, there is no need of carrying out a complex and cumbersome operation for maintaining synchronism between the hands and the timing data of the analog electronic timepiece after every replacement of the cell unlike the prior art, making it possible to utilize the electronic device such as the multi-functional timepiece without the need of giving attention to whether the synchronism is maintained between the analog hands and the digital timing data, contributing to greatly enhancing the commercial value of the electronic device.

Described below with reference to the drawings is an example in which a cell which is the power source is removed from the electronic timepiece and a new cell is loaded.

According to the present invention, the operation for removing the cell 2 from the analog electronic timepiece 1 should desirably be carried out in at least two steps as described above. In the first operation, it is necessary to estimate that the cell 2 is going to be removed from the analog electronic timepiece 1. Concretely speaking, the first operation is carried out under a condition where a back 101 is removed from the analog electronic timepiece as shown in FIG. 10, or under a condition where a pushing plate 103 that pushes the cell 2 provided in the analog electronic timepiece 1 is connected to a predetermined cell detecting lever 123 which is then manipulated to take out the cell 2 as shown in FIGS. 11 to 13.

The second operation according to the present invention is to take out the cell from the electronic device 1 following the above first operation, without needing any particular device or means.

The first operation according to the present invention will be concretely described below later.

Another constitution of the analog electronic timepiece 1 according to the present invention is basically the same as the aforementioned constitution shown in FIG. 1, but comprises the data storage instruction means 12 which includes a detecting circuit 12' for detecting the voltage of the cell 2 and a means that generates a signal notifying the removal of the cell, and the data read instruction means 6 which includes a switch block constituted by a plurality of switch blocks 6*a* to 6*d* for reading the data stored in the nonvolatile memory 4 again into the hand position counter 15. Though the connection between the data storage instruction means 12 and the hand drive data control means 5 is different to some extent from the one shown in FIG. 1, the basic functions and the operations are nearly the same as those of FIG. 1.

Figure 7:
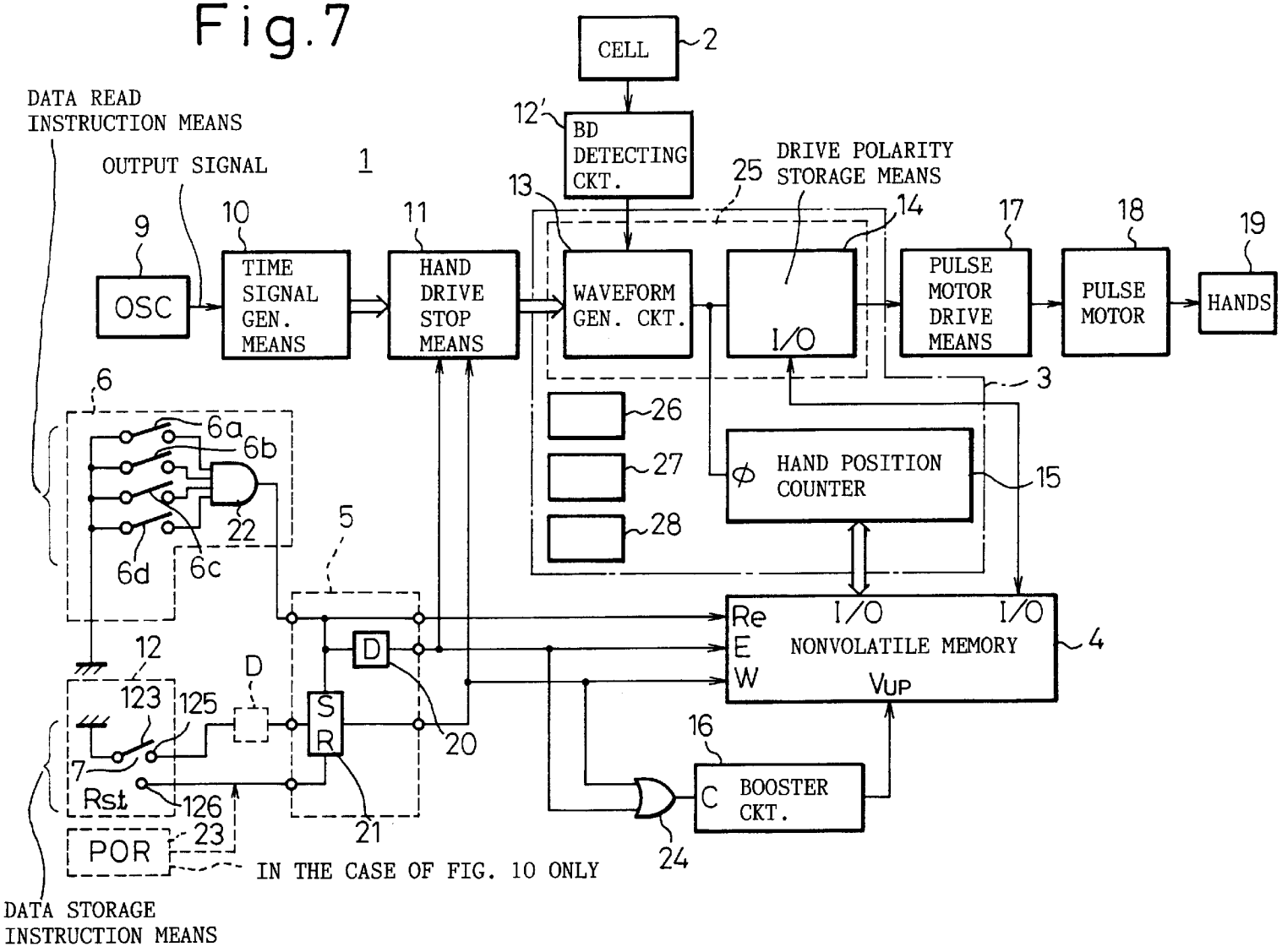
FIG. 7 is a block diagram illustrating another constitution of the hand display-type electronic timepiece according to the present invention.

That is, as shown in FIG. 7, provision is made of a suitable reference pulse signal generating means (OSC) 9, a time signal generating means 10 which is connected to the reference pulse signal generating means (OSC) 9 and has a suitable frequency-dividing function, and a hand drive stop means 11 which receives an output from the time signal generating means 10 and sends the output signal of the time signal generating means 10 to the hand position data generating means 3 depending upon the control signal of the hand drive data control circuit 5.

According to this embodiment, furthermore, the signal is interrupted from being fed to the hand position counter 15 provided in the hand position data generating means 3 that will be described later, and the timing data displayed by the hands 19 and the timing data indicated by the hand position counter are brought to a halt maintaining synchronism therebetween.

In the present invention, therefore, the hand drive data control circuit 5 works to turn the hand drive stop means 11 on to stop the hands 19 in response to a write signal output from a power source attach/detach detecting means 7 which constitutes a switch means that operates in response to the above-mentioned first operation.

According to the second embodiment of the present invention as will be obvious from the aforementioned constitution, the hand drive data control circuit 5 controls the hand position counter 15, hand drive stop means 11, non-volatile memory 4 and booster circuit 16 in such a manner that they are linked to each other. Concretely speaking, when the hand drive data control circuit 5 operates, the hand drive stop means 11 is turned on to block the pulse signal of the time signal generating means 10 from being fed to the pulse motor drive control means 25 in the hand position data generating means 3. Therefore, the hand position counter 15 stops the counting operation and holds the counted value of that moment.

According to the above-mentioned second embodiment of the present invention, furthermore, the non-volatile memory 4 is provided with a suitable booster means 16 which, when predetermined data are to be written into the nonvolatile memory 4, applies a predetermined high voltage as an operation voltage to the nonvolatile memory 4 and, even when new data are to be written into the nonvolatile memory 4, applies a high operation voltage to the nonvolatile memory 4 since the data remaining in the nonvolatile memory 4 must be erased.

Moreover, the hand drive data control circuit 5 according to the present invention is connected to a suitable data storage instruction means 12, and the data read instruction means 6 provided separately from the data storage instruction means 12 is equipped with the cell detecting switch 123 that constitutes the power source attach/detach detecting means 7 as described above.

Provision is further made of switches 6*a* to 6*d* that correspond to switches which are used for resetting or correcting counter values in the analog electronic timepiece or that correspond to switches which are operated for selecting the modes.

That is, according to the present invention, the data storage instruction means 12 is provided with a group of circuits that generate instructions which cause the nonvolatile memory 4 to read predetermined data from the hand position counter 15, i.e., is provided with the cell detecting switch 123 which constitutes the power source attach/detach detecting means 7, and the data read instruction means 6 is provided with a group of circuits that generate instructions for reading data stored in the nonvolatile memory 4, i.e., provided with switches 6*a* to 6*d* that are reset or are operated to select a mode.

Described below in detail are constitutions of the hand drive data control circuit 5, data storage instruction means 12 and data read instruction means 6, and mutual relations among them.

The data read instruction means 6 is constituted by switches 6*a* to 6*d* that correspond to reset and mode switches. The switches 6*a* to 6*d* of the data read instruction means 6 are connected to the AND gate 22 which outputs a read signal that will be described later to the hand drive data control circuit 5 only when the switches 6*a* to 6*d* are turned on simultaneously.

A concrete method of removing the cell from the electronic timepiece and for loading the electronic timepiece with a new cell according to the invention will now be described with reference to FIGS. 7 and 11.

That is, as shown in FIG. 11, the means 7 for detecting the attachment or detachment of the cell 2 which is the power source is constituted by the cell detecting lever 123 which moves by being linked to the operation for removing the cell 2, a write terminal 125 that comes in contact with the cell detecting lever 123 during the first operation for removing the cell 2, and a reset terminal 126 that comes into contact with the cell detecting lever 123 during the second operation.

The hand drive data control circuit 5 has a set/reset gate means 21 (hereinafter referred to as SR gate means 21) which controls the passage of a write signal that corresponds to the first operation from the write terminal 125 which constitutes the power source attach/detach detecting means 7, and a delay circuit 20 which delays the read signal from the AND gate 22 and outputs it as an erase signal. The SR gate means 21 receives a write signal from the AND gate 22 through an S (set) terminal thereof and receives a reset signal from the reset terminal 126 constituting the power source attach/detach detecting means 7 through an R (reset) terminal thereof. The SR gate means 21 permits the passage of the write signal from the write terminal 125 when it is in the set condition but does not permit the passage of the write signal when it is in the reset condition.

The write signal from the SR gate means 21 is fed as an ON signal to the hand drive stop means 11, and is fed as an operation signal to the nonvolatile memory 4 through a write signal terminal W and to the booster circuit 16 through an OR gate 24. The signal from the delay circuit 20 is fed as an OFF signal to the hand drive stop means 11, and is fed as an erase signal to the nonvolatile memory 4 through an E terminal and as an operation signal to the booster circuit 16 through the OR gate 24. Furthermore, the signal from the AND gate 22 that is directly output from the hand drive data control circuit 5 is fed as a read signal to the nonvolatile memory 4.

Therefore, as the power source attach/detach detecting means 7 detects the first operation which indicates the removal of the cell 2 for replacement and outputs a detect signal, the hand drive stop means 11 is turned on and the output signal of the time signal generating means 10 is no longer fed to the control circuit 3. Accordingly, the hand position counter 15 stops and the hands 19 stop moving.

At the same time, the nonvolatile memory 4 receives a write signal from the SR gate means 21 in the hand drive data control circuit 5, reads the data stored in the hand position counter 15 and the data stored in the drive polarity storage means 14, and then writes the data therein.

At this moment, the booster means 16 has been driven simultaneously with the detection of the power source detecting signal and the nonvolatile memory 4 is supplied with an operation voltage of a high level that is necessary for the writing operation.

That is, according to the present invention, the hand drive stop means 11 is operated in response to the write operation of the power source attach/detach detecting means 7, and the data of the hand position counter 15 and of the drive polarity storage means 14 are written onto the nonvolatile memory 4.

In the present invention as described above, synchronism is maintained between the timing data displayed by the hands and the timing data of the hand position counter 15 in the hand position data generating means 3 prior to removing the cell, and the data are written into the nonvolatile memory 4 while maintaining synchronism between the polarity of the drive polarity storage means 14 and the polarity of the pulse motor 18. When the renewal of the cell is finished, the timing data stored in the nonvolatile memory 4 and the polarity data are read into the hand position data generating means 3 to resume the timing operation. It is therefore allowed to resume the timing operation maintaining perfect synchronism between the data displayed by the hands 19 and the data of the hand position counter 15. When the new cell 2 is loaded, a reset signal is output from the reset terminal 126 and the SR gate means 21 of the hand drive data control circuit 5 is reset, as will be described later concretely.

When the renewal of the cell is finished in the present invention, the hand drive data control circuit 5 works to read the data stored in the nonvolatile memory 4 into the hand position data generating means 3 in response to an output signal from the AND gate 22 in the data read instruction means 6 that indicates that the analog electronic timepiece is loaded with the new cell.

In this embodiment, the signal which indicates that the analog electronic timepiece is loaded with the new cell is produced from the AND gate 22 when a condition which does not usually exist is intentionally established by the user by simultaneously manipulating a plurality of, for example, four switches 6*a* to 6*d* after the cell is replaced, as shown in FIG. 7.

Furthermore, any signal can be used to indicate the renewal of the cell provided the signal guarantees that the cell 2 has been completely loaded and that the whole circuit has been supplied with the voltage of the cell 2, such as a signal that is produced upon detecting the closure of the back of the analog electronic timepiece or upon detecting the restoration of the pushing plate into the initial state as described earlier.

That is, the hand drive data control circuit 5 reads the data stored in the nonvolatile memory 4 into the hand position counter 15 and the drive polarity storage means 14 in the hand position data generating means 3 in response to a signal which indicates that the analog/digital electronic timepiece 1 is loaded with the new cell 2, turns the hand drive stop means 11 off after the passage of a predetermined delay time that is set by the delay circuit 20 to drive the hands 19 and to drive the booster circuit 16 via OR gate 24, and erases the data from the nonvolatile memory 4.

In practical operation, a signal indicating the renewal of the cell 2 is input to the hand drive data control circuit 5, and is then readily input to the read terminal Re of the nonvolatile memory 4, whereby the timing data and polarity data stored in the nonvolatile memory 4 are read into the hand position counter 15 and the drive polarity storage means 14 in the hand position data generating means 3 and are stored therein.

Then, after the passage of a predetermined delay time for stabilizing the reading operation that is determined by the delay means 20, a reset signal is output to the hand drive stop means 11 which is then turned off. Therefore, the pulse signal of the time signal generating means 10 is fed to the pulse motor drive means 17 via the pulse motor control circuit 25 in the hand position data generating means 3, and the hands 19 start moving with the timing data read from the hand position counter 15 as start data.

Concretely described below is the first operation and the second operation for removing the cell 2 according to the present invention. FIGS. 11 to 13 illustrate the first operation and the second operation according to the above-mentioned embodiment of the present invention.

FIG. 11 is a plan view of the analog electronic timepiece 1 according to the present invention viewed from the back side, and wherein the back 101 has been removed.

Figure 11A:
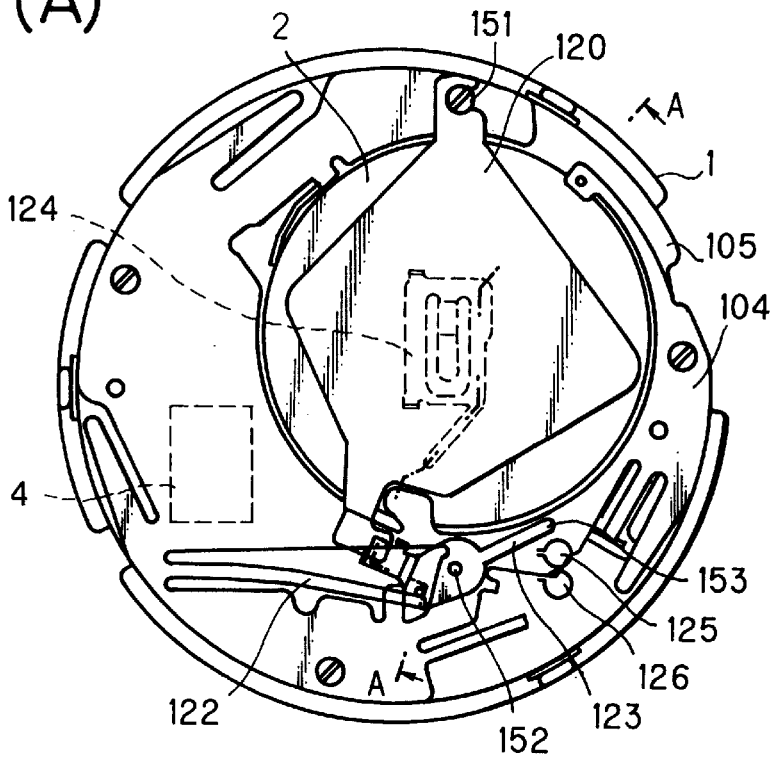
FIGS. 11(A), 11(B) and 11(C) are diagrams illustrating another means for detecting the first operation according to the present invention.

Referring first to FIG. 11(A), the cell 2 is supported and secured at its periphery by the circuit support plate 104, and its bottom surface is covered and held by a cell holding plate 120.

The cell holding plate 120 is secured by a screw 151 and the cell detecting lever 123. By removing the screw 151, the cell holding plate 120 can be easily separated from the case 105.

The cell holding plate 120 has the cell detecting lever 123 provided at an end thereof. The cell detecting lever 123 is biased by a return spring 122 that is formed integrally with the circuit support plate 104 in a manner to turn clockwise with the rotary shaft 152 as a center. When the cell holding plate 120 is set, the condition is maintained as shown in FIG. 11(A), whereby a tip 153 of the cell detecting lever 123 is located at a position where it is not connected to the write terminal 125 of the power source attach/detach detecting means 7 that is provided in the circuit board 103.

The cell 2 is urged toward the cell holding plate 120 by a cell receiving spring 124 provided on the circuit board 103. The electronic circuit of the analog electronic timepiece 1 is supplied with electric power via the circuit support plate 104 and the cell receiving spring 124.

Figure 11B:
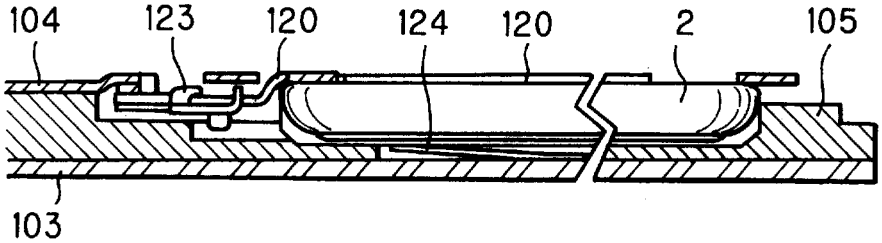

FIG. 11B is a sectional view of FIG. 11(A) illustrating a relationship in position among the cell 2, cell holding plate 120 and cell detecting lever 123.

Figure 11C:
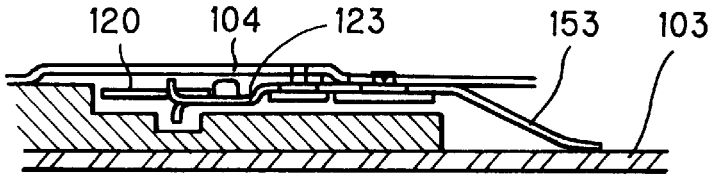

FIG. 11(C) is a sectional view illustrating the connection between the tip 153 of the cell detecting lever 123 and the write terminal 125 or the reset terminal 126 of the power source attach/detach detecting means 7 of FIG. 11(A).

When the cell holding plate 120 exists, the tip 153 of the cell detecting lever 123 is not connected to the write terminal 125 of the power source attach/detach means 7, and the synchronism processing operation of the present invention is not executed.

Figure 12A:
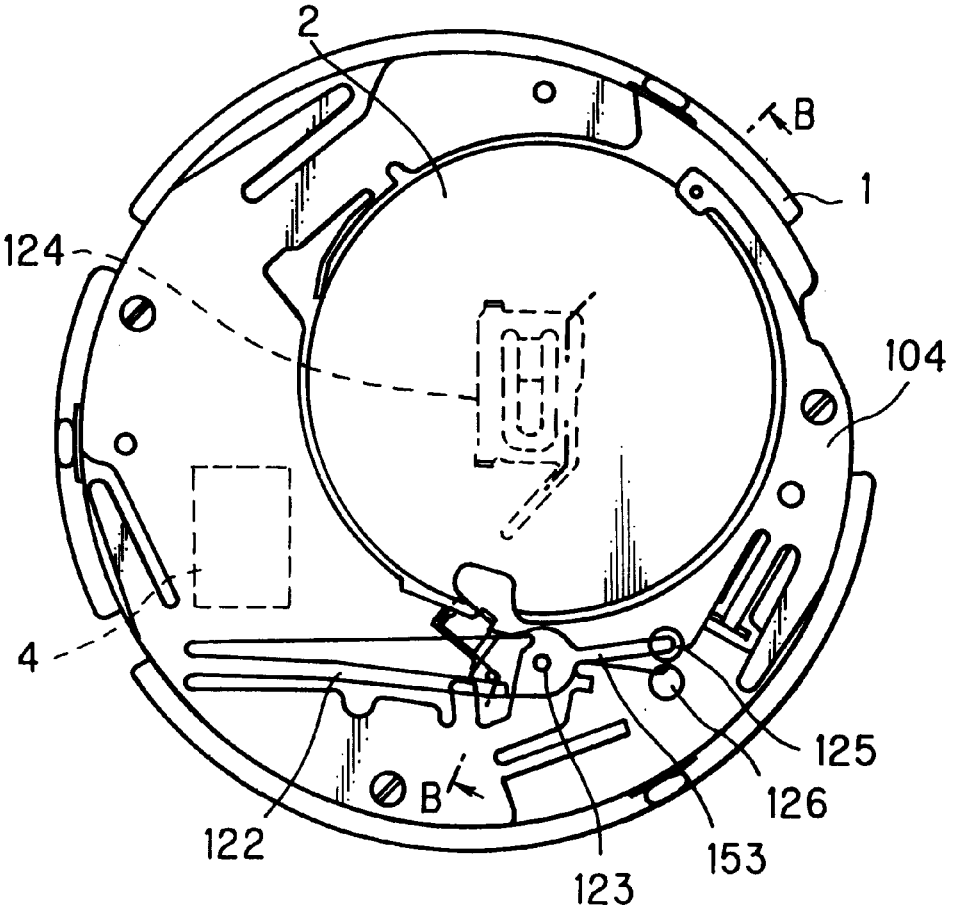
FIGS. 12(A) and 12(B) are diagrams illustrating a further means for detecting the first operation according to the present invention.

Referring next to FIG. 12(A), when the cell holding plate 120 is removed to renew the cell 2, the cell detecting lever 123 rotates in the clockwise direction due to the action of the return spring 122, whereby the tip 153 of the cell detecting lever 123 comes into contact with the write terminal 125 of the power source attach/detach detecting means 7. Therefore, the hand drive data control circuit 5 shown in FIG. 1 or 7 is operated, the hand drive stop means 11 is turned on via the SR gate means 21, the pulse signal of the time signal generating means 10 is no longer fed to the hand position data generating means 3 and the hands 19 stop moving, and the nonvolatile memory 4 reads the contents stored in the hand position counter 15 and in the drive polarity storage means 14 in the hand position data generating means 3 and stores the contents therein.

Figure 12B:
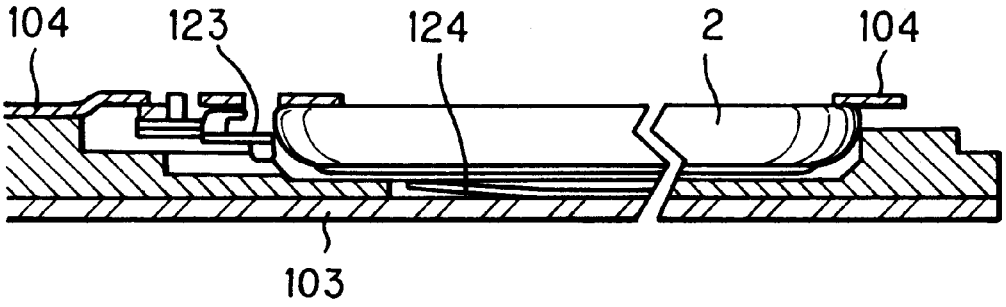

Even under the above-mentioned condition, the cell 2 is firmly held at its peripheral portion by the circuit support plate 104 as shown in FIG. 12(B). Therefore, the electric connection is still maintained between the cell 2 and the analog electronic timepiece 1, and the above-mentioned data writing operation is guaranteed.

Thus, the aforementioned first operation is reliably executed.

Figure 13A:
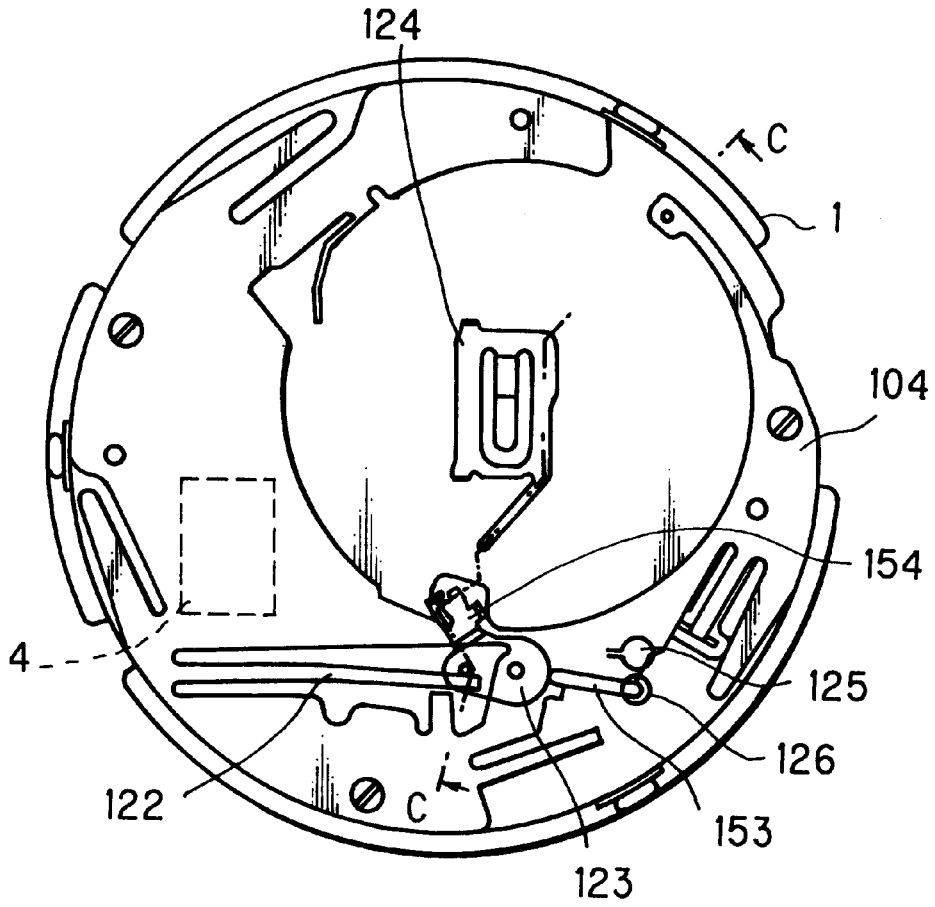
FIGS. 13(A) and 13(B) are diagrams illustrating a yet further means for detecting the first operation according to the present invention.

FIG. 13(A) illustrates the second operation condition in which the cell 2 is removed from the analog electronic timepiece 1. With the cell 2 being removed, the cell detecting lever 123 is allowed to rotate in the clockwise direction due to the action of the return spring 122 until it is connected to the reset terminal 126 formed on the circuit board 103 and stably remains stationary in this condition.

Figure 13B:
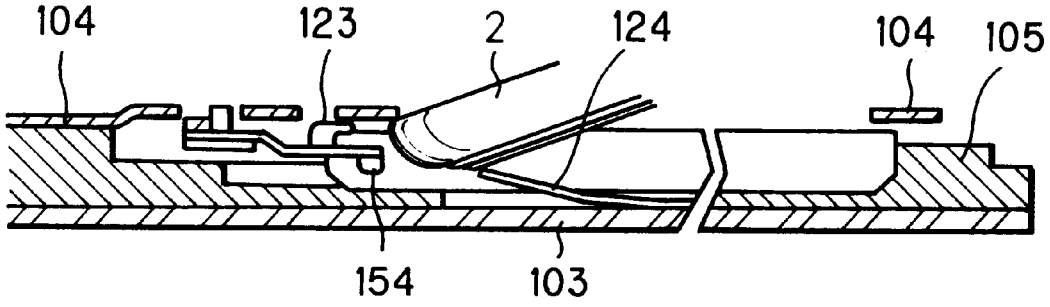

FIG. 13(B) illustrates the operation in which the new cell 2 is inserted in the analog electronic timepiece 1, contrary to the above. The procedure is just opposite to the above-mentioned step. To insert the cell 2, first, an end of the cell 2 is inserted at an angle between the cell receiving spring 124 and the circuit support plate 104, and is then inserted in a manner to push the cell receiving spring 124 and a base portion of the cell detecting lever 123.

At this moment, prior to coming into contact with the cell detecting lever 123, the cell 2 comes into contact with the circuit support plate 104 and the cell receiving spring 124 to feed electricity to the whole electronic circuit, and a reset signal is fed from the reset terminal 126 to the hand drive data control circuit 5 via the circuit support plate 104 and the cell detecting lever 123 which is in contact in order to reset the SR gate means 21. Thereafter, as shown in FIG. 12(A), the cell 2 is completely loaded and the cell detecting lever 123 comes into contact with the write terminal 125. As described above, however, the SR gate means 21 has been reset and no write signal is output. Furthermore, the cell holding plate 120 is mounted and the tip 153 of the cell detecting lever 123 is separated away from the write terminal 125 of the power source attach/detach means 7 to restore the condition for starting the timing operation. Then, as described with reference to FIG. 1 or 7, the switches 8*a* to 8*d* are simultaneously manipulated to read the data of the nonvolatile memory 4 into the hand position counter 15 and the drive polarity storage means 14. Then, the hand drive stop means 11 is turned off to start the timing operation.

FIG. 10 illustrates the first and second operations according to another embodiment of the present invention.

In FIG. 10, when the back 101 is removed from the analog electronic timepiece 1 according to the first operation, it is estimated that the cell 2 is going to be removed. When the operation is carried out to remove the back 101, therefore, the power source attach/detach detecting means 7 is operated.

Figure 10A:
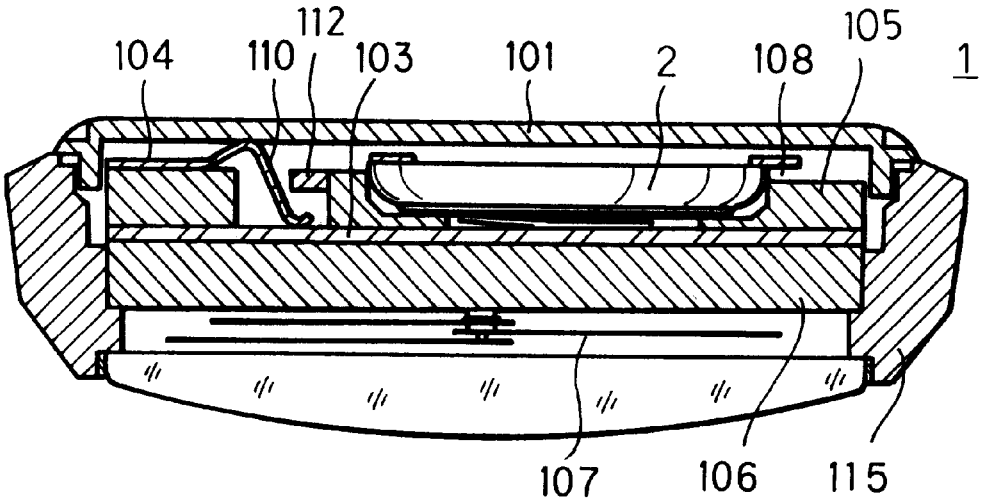
FIGS. 10(A) and 10(B) are diagrams illustrating a means for detecting a first operation according to the present invention.

Therefore, as long as the back 101 is secured onto the back side of the case 105 of the analog electronic timepiece 1, a switch piece 110 supported by the circuit support plate 104 is maintained in a condition of being separated away from an electrical contact 112 which is provided, for example, on the side surface of the cell support portion 105 as shown in FIG. 10(A). In this condition, therefore, no write signal is generated at the write terminal 125 of the cell attach/detach detecting means 7, and the device does not operate.

That is, according to this embodiment, the cell attach/detach detecting means 7 of the present invention is constituted by the switch piece 110 and the electrical contact 112.

Reference numeral 107 denotes hands and 108 a pushing plate that supports the cell.

Figure 10B:
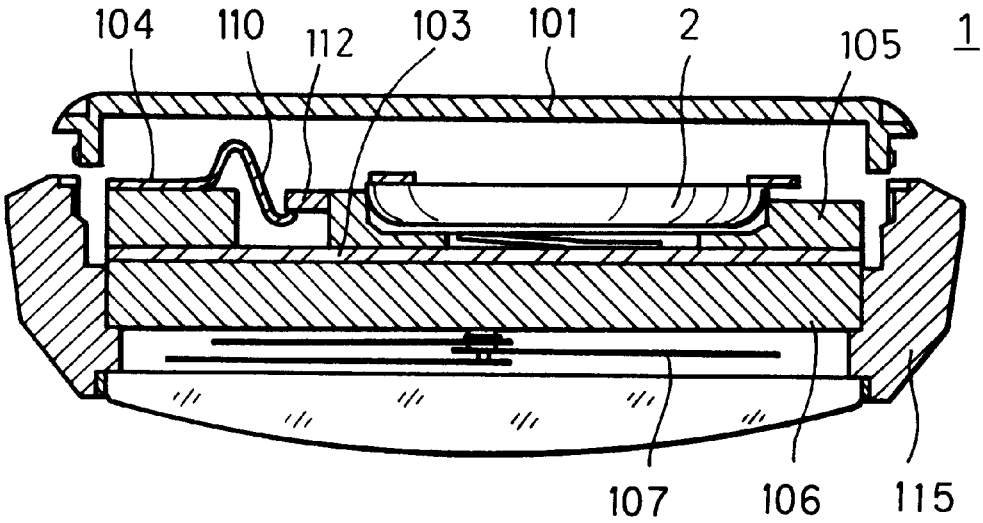

FIG. 10(B) illustrates the state where the back 101 is removed. In this condition, the switch piece 110 and the electric contact 111 are electrically connected to each other.

Upon detecting this condition, therefore, it is judged that the above-mentioned first operation is carried out. A write signal is output from the write terminal 125 of the data storage instruction means 12 shown in FIG. 7, and the hand drive data control circuit 5 is operated.

Though no pattern is described that corresponds to the reset terminal 126 of FIG. 7, this embodiment is so constituted that a reset signal is generated from the power-on reset circuit (POR) indicated by a dotted line in FIG. 7 when the new cell 2 is loaded thereby to reset the SR gate means 21. Therefore, no write signal is output. Thereafter, the switches 6*a* to 6*d* of the data read instruction means 6 are simultaneously pushed to resume the aforementioned timing operation.

The procedure of operation of the electronic timepiece 1 according to the present invention will now be described with reference to flowcharts of FIGS. 8 and 9.

Figure 8:
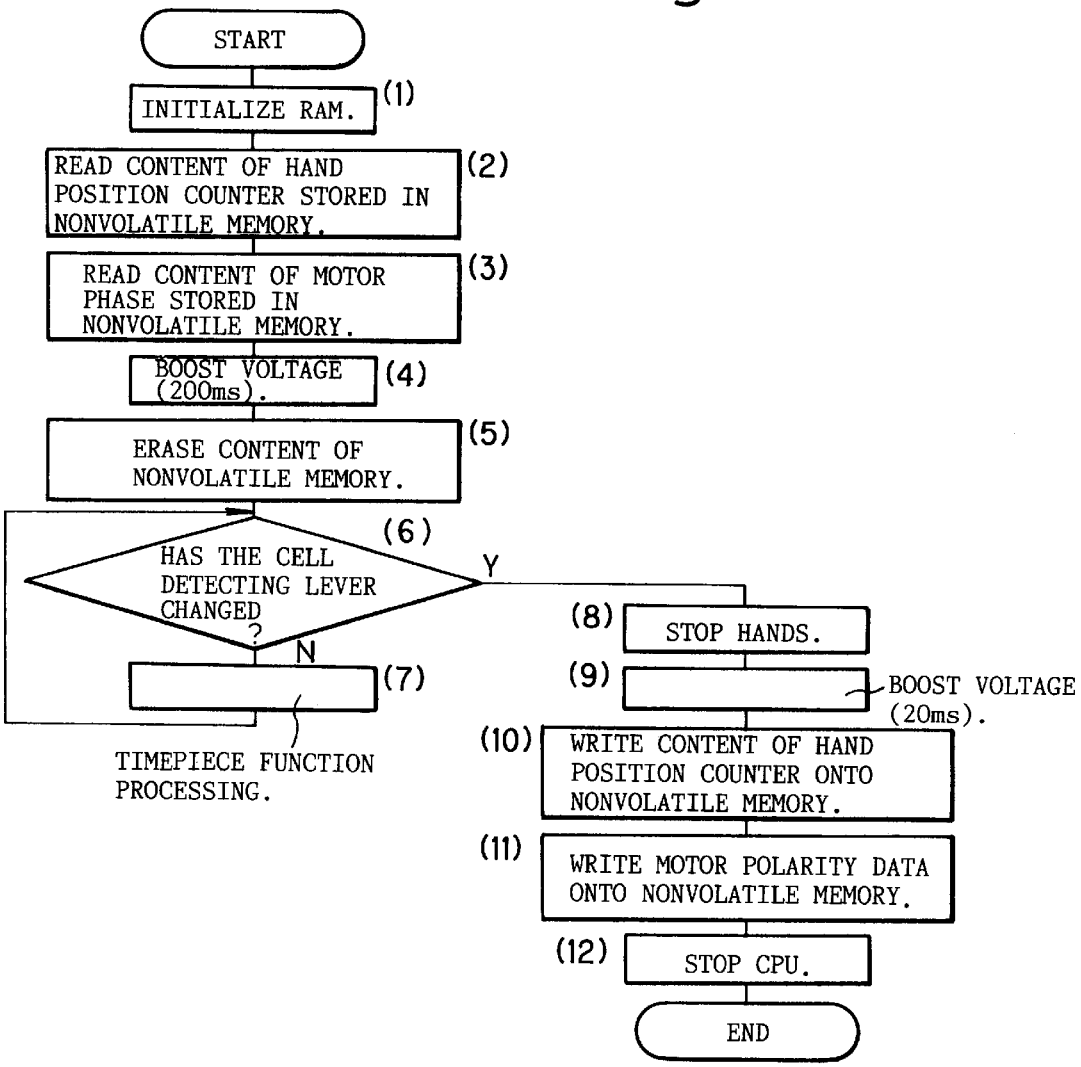
FIG. 8 is a flowchart illustrating a procedure for operating the hand display-type electronic timepiece according to the present invention.

FIG. 8 is a flowchart illustrating the procedure of operation of the analog electronic timepiece according to the present invention, i.e., illustrating the procedure of operation after the cell is renewed.

After the start, the RAM is initialized at a step (1). The program then proceeds to a step (2) where the data of the hand position counter 15 stored in the nonvolatile memory 4 is read. Then, at a step (3), the data of the drive polarity storage means 14 stored in the nonvolatile memory 4 is read to drive the pulse motor control means 25.

After a predetermined delay time has passed at a step (4), the booster means 16 is operated to supply a boosted voltage to the nonvolatile memory 4. Then, at a step (5), the content stored in the nonvolatile memory 4 is erased.

It is desired that the boosting operation at the step (4) is carried out for a period of, for example, 200 ms, so that the erasing effect is reliably obtained.

The program then proceeds to a step (6) where it is judged whether the write signal of the power source attach/detach detecting means 7 has changed.

In the step (6), the condition in which the hands are driven undergo a change due to a detect signal of the power source voltage detecting circuit 12', or an alarm buzzer is energized or light is emitted, whereby the user judges that it is the time to replace the cell 2, and will then try to replace the cell 2.

As the power source attach/detach detecting means 7 detects the first operation which is carried out estimating the operation of removing the cell 2 as described above and as the write signal is output, the processing at the step (6) becomes YES and the program proceeds to a step (8). When the processing at the step (6) is NO, however, the program proceeds to a step (7) where the timing operation processing is executed to carry out an ordinary timing function, and the program returns to the step (6) to repeat the above-mentioned steps.

At the step (8), the hand drive stop means 11 is turned on, and the output signal from the time signal generating means 10 is not fed to the pulse motor control means 25 via the hand position data generating means 3, whereby the hands 19 stop moving and, at the same time, the hand position counter 15 discontinues the counting operation. Therefore, the timing data at this moment are stored in the hand position counter 15 in synchronism with the position data of the hands 19.

The booster means 16 is driven at a step (9), whereby a boosted voltage is fed to the nonvolatile memory 4; i.e., the data can be written into the nonvolatile memory 4.

The boosting operation at the step (9) will be sufficient if it lasts for, for example, about 20 ms.

Then, at a step (10), the timing data stored in the hand position counter 15 are read out and are written into the nonvolatile memory 4.

The program then proceeds to a step (11) where the polarity data of alternating pulses stored in the drive polarity storage means 14 are read out and are written into the nonvolatile memory 4.

As the cell is removed, thereafter, the functions of all circuits (inclusive of the CPU) of the analog electronic timepiece are stopped (step (12)) END.

Figure 9:
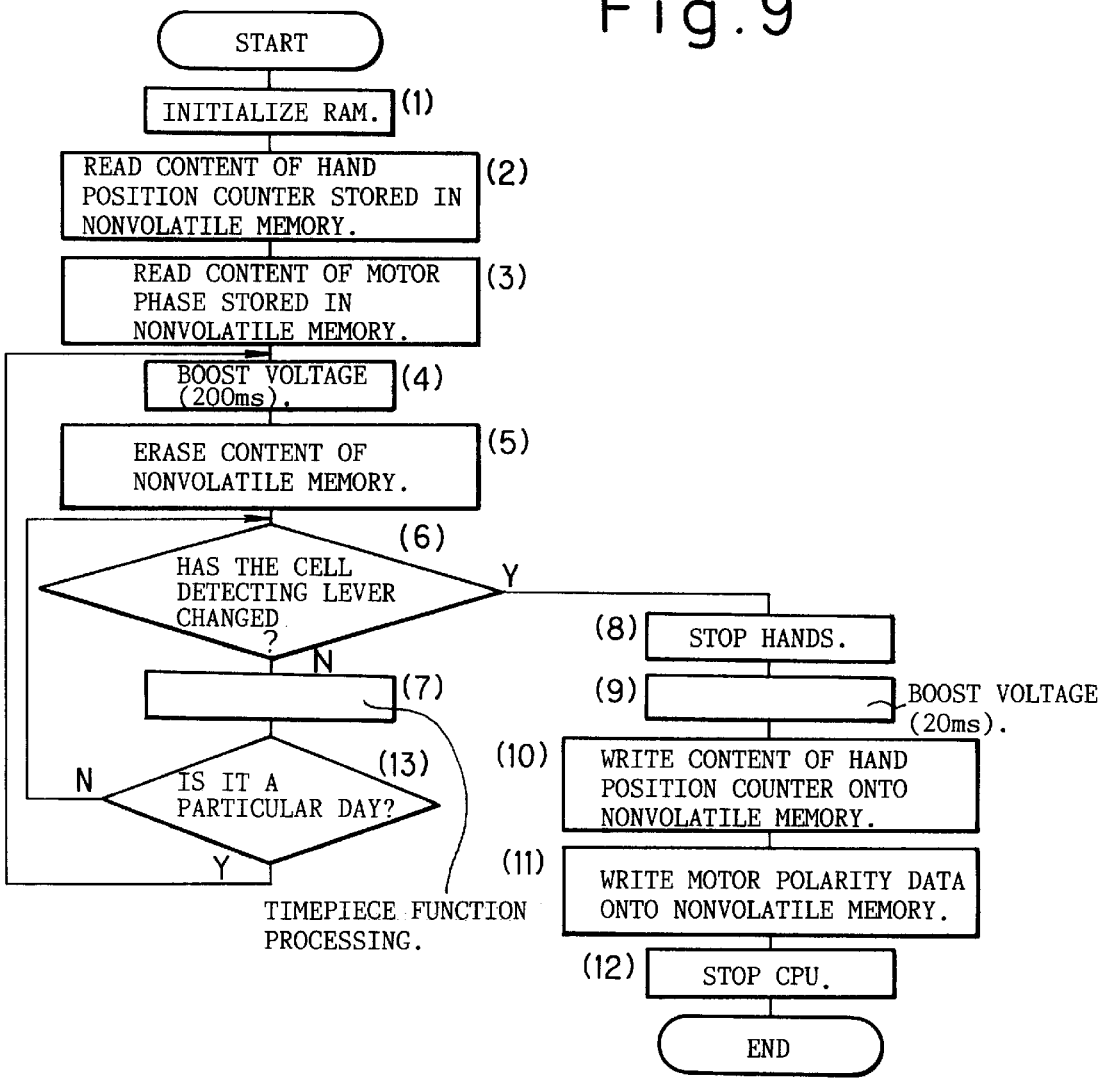
FIG. 9 is a flowchart illustrating another procedure for operating the hand display-type electronic timepiece according to the present invention.

FIG. 9 illustrates a flowchart showing another embodiment of the present invention differing from the flowchart of FIG. 8. What makes a difference from that of FIG. 8 is that a step (13) is newly added after the step (7). After the ordinary timing operation is started at the step (7), the step (13) repeats the operation for erasing the content of the nonvolatile memory 4 at predetermined time periods. This makes it possible to write the contents of the hand position counter 15 and the drive polarity storage means 14 into the nonvolatile memory 4 at any time.

That is, the step (13) judges whether a predetermined day or time has arrived. When the answer is no, the program returns back to the step (6) and the steps up to this point are repeated. When the answer is YES, the program returns to the step (4) to repeat the steps up to this point.

According to the present invention, when the user of the hand display-type electronic timepiece executes the operation for replacing the power source such as a cell after having confirmed that the potential of the power source has dropped below the required voltage level, the timing data or the time data are initially stored in the nonvolatile memory under the condition in which the hand positions and the time data of the timing counter or the hand position counter are in perfect synchronism with each other. The timing data or the time data stored in the nonvolatile memory are then read into the hand position counter to resume the timing operation after the operation for replacing the power source such as a cell has been finished. Therefore, the hands and the hand position counter of the electronic device can be started again under the condition in which is maintained synchronism of before the power source such as cell was replaced.

According to the hand display-type electronic timepiece of the present invention, therefore, no complex operation is required for maintaining synchronism between the hands and the timing counter unlike that of the prior art. That is, without the need of effecting any particular operation for maintaining synchronism, the power source such as a cell can be replaced while automatically maintaining synchronism therebetween, contributing to greatly enhancing the commercial value of the hand display-type electronic timepieces.

With reference to FIG. 2 which illustrates another embodiment of the present invention, provision is made of a radio receiving circuit 50 as indicated by a dotted line.

In the hand display-type electronic timepiece according to this embodiment, the radio receiving circuit 50 which is an antenna is provided at a suitable place. In an area where the time is converted into predetermined digitized codes that are emitted into the air as radio waves, the radio receiving circuit 50 receives the radio waves and converts them to easily correct the present time.

The timepiece of this type has been called a radio timepiece or radio-controlled timepiece, and its concrete constitution has been disclosed in, for example, U.S. Pat. No. 5,077,706 or Japanese Unexamined Patent Publication (Kokai) No. 61-155789.

When the radio timepiece is limited to the digital display-type only, no problem arises since the content of the time counter corrected by the radio wave signals is directly displayed on the digital display device. When the radio timepiece is an analog electronic timepiece like that of the present invention, however, the aforementioned problem is involved. In the radio timepiece of which the prerequisite is no time-setting operation being required, in particular, any operation that is required for maintaining synchronism between the hands and the timing counter greatly deteriorates the value of the radio timepiece. Therefore, the technology of the present invention is required for the radio timepiece and greatly contributes to putting the analog radio electronic timepiece into practical use.

The procedure for operating the hand display-type electronic timepiece 1 according to the present invention will now be described with reference to a flowchart of FIG. 14.

Figure 14:
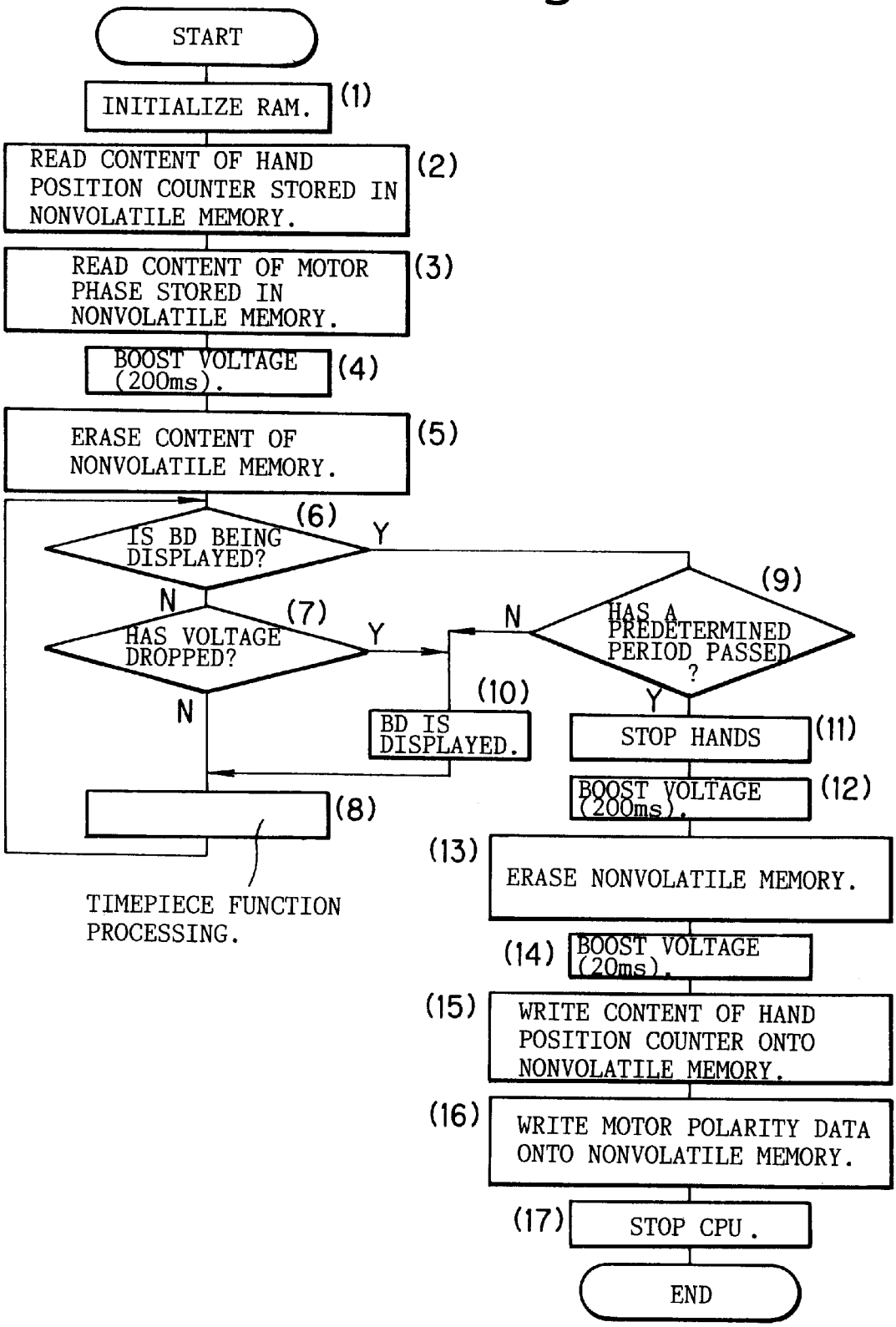
FIG. 14 is a flowchart illustrating a procedure for operating an analog/digital timepiece in the hand display-type electronic timepiece according to the present invention.

FIG. 14 is a flowchart illustrating the procedure for operating the hand display-type electronic timepiece according to the present invention, i.e., illustrating the procedure of operation after the cell is replaced.

After the start, the RAM is initialized at a step (1). The program then proceeds to a step (2) where the data of the hand position counter 15 stored in the nonvolatile memory 4 is read. Then, at a step (3), the data of the drive polarity storage means 14 stored in the nonvolatile memory 4 is read to drive the pulse motor control means 25.

After a predetermined delay time has passed at a step (4), the booster means 16 is operated to supply a boosted voltage to the nonvolatile memory 4. Then, at a step (5), the content stored in the nonvolatile memory 4 is erased.

It is desired that the boosting operation at the step (4) is carried out for a period of, for example, 200 ms, so that the erasing effect is reliably obtained.

Then, the program proceeds to a step (6) where it is judged whether the voltage drop signal of the power source voltage detecting means 12 is displayed or not. When the answer is NO, the program proceeds to a step (7) where it is judged whether the voltage has dropped in the power source voltage detecting means 12. When the answer is YES, the program proceeds to a step (10) where the waveform generating circuit 13 is controlled by a detect signal of the power source voltage detecting means 12 to display the detection of two-second hand motion. The program then proceeds to a step (8) where the arithmetic operation is executed for the ordinary timing operation.

When the answer is NO at the step (7), the program proceeds directly to the step (8) and returns to the step (6) to repeat the above-mentioned steps to thereby carry out ordinary timing operation and the power source voltage-detecting operation.

When the answer is YES at the step (6), on the other hand, the program proceeds to a step (9) where it is judged whether a predetermined delay period set by the delay means 60 has passed or not. When the answer is NO, the program returns back to the step (10). When the answer is YES, the program proceeds to a step (11) where the hand drive stop means 11 is turned ON. Therefore, the drive signal pulse is no longer fed from the time signal generating means 10 to the pulse motor drive means 17 via the hand position data generating means 3, whereby the hands 19 stop moving and, at the same time, the hand position counter 15 discontinues the counting operation. The timing data at this moment are stored in the hand position counter 15 maintaining synchronism with the position data of the hands 19.

Then, at a step (12), the booster means 16 is driven to feed a boosted voltage to the nonvolatile memory 4. Thus, the nonvolatile memory 4 is placed in the condition where the data written therein can be erased.

The time of the boosting operation employed in the step (12) may be, for example, about 200 ms.

Next, at a step (13), the data of the nonvolatile memory 4 are erased, and the boosting means 16 is operated again at a step (14) to be ready for the writing operation.

The time of boosting operation of, for example, about 20 ms will be sufficient at the step (14).

The program then proceeds to a step (15) where the timing data stored in the hand position counter 15 are read out and are written into the nonvolatile memory 4.

Thereafter, the program proceeds to a step (16) where the polarity data of a drive pulse stored in the drive polarity storage means 14 is read out and is written into the nonvolatile memory 4.

Then, as the cell is removed, the functions of all circuits (inclusive of the CPU) of the analog electronic timepiece are stopped (step (17)) END.

Next, described below is the constitution of the hand display-type electronic timepiece according to an optimum embodiment of the present invention.

Figure 15:
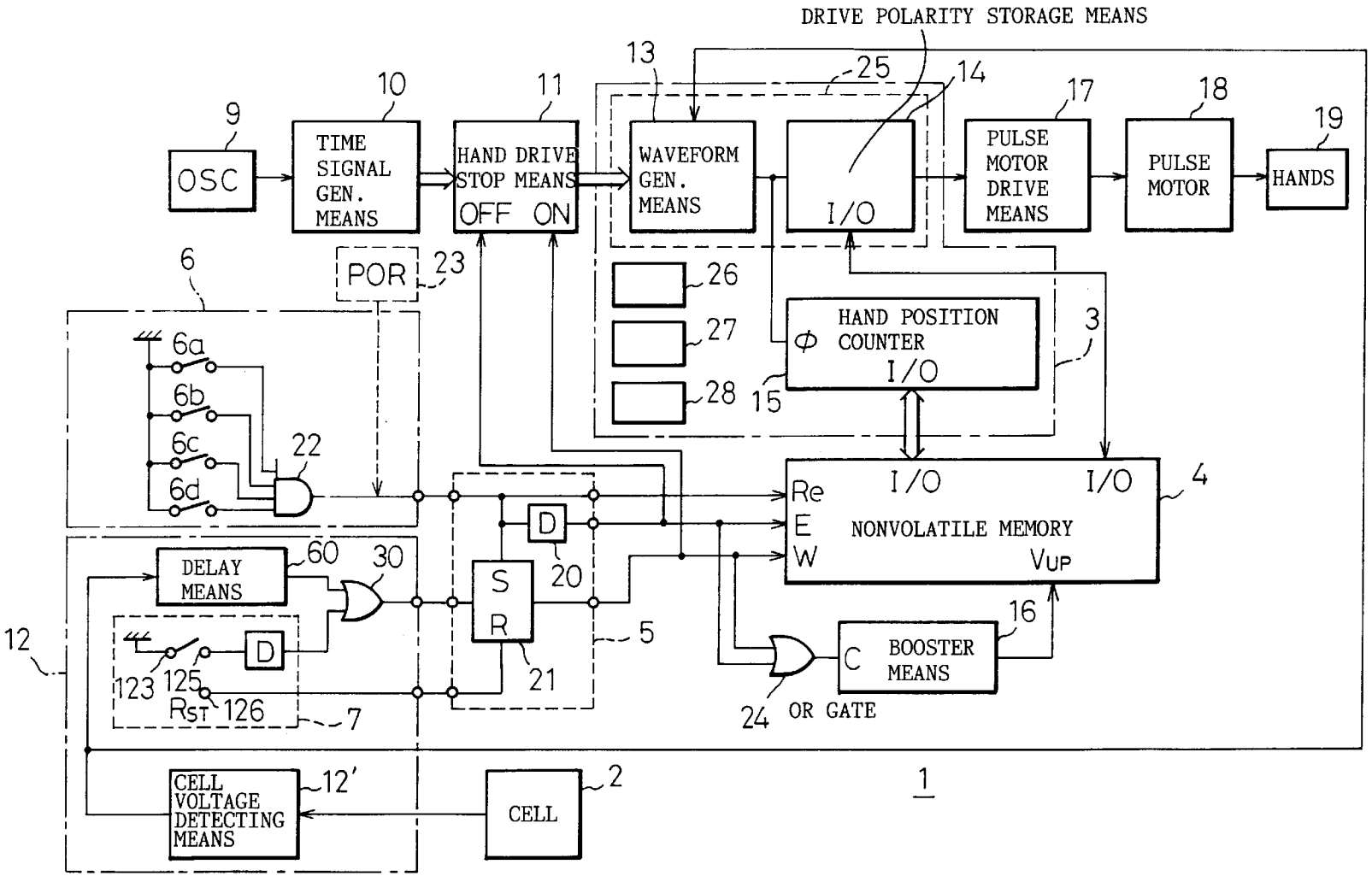
FIG. 15 is a block diagram illustrating another constitution of the hand display-type electronic timepiece according to the present invention.

That is, the hand display-type electronic timepiece according to this embodiment has a constitution that includes all the constitutions of the aforementioned embodiments. Concretely speaking as shown in a block diagram of FIG. 15, this embodiment employs the constitution described below.

That is, a hand position storage-type electronic timepiece 1 constituted by a power source 2 of a cell, a time signal generating means 10, a pulse motor drive means 17, a pulse motor 18, hands 19 driven by the pulse motor 18, a hand position data generating means 3 which generates hand position data corresponding to the hands 19, a hand drive stop means 11 which controls the supply of signals to the pulse motor drive means 17, a nonvolatile memory 4 for storing hand position data that are stored in the hand position data generating means 3, a hand drive data control circuit 5 that controls the nonvolatile memory 4, the hand position data generating means 3 and the hand drive stop means 11, and a data storage instruction means 12 which controls the hand drive data control circuit 5, and in which the hands are driven according to the hand position data generating means 3, wherein the data storage instruction means 12 is constituted by a cell voltage detecting means 12' that detects the voltage drop of the cell 2 and a cell attach/detach detecting means 7 which functions by being linked to the operation for attaching or detaching the cell 2, and the hand drive data control circuit 5 stops the hands by controlling the hand drive stop means 11 in response to either an output signal from the voltage detecting means 12' or an output signal from the cell attach/detach means 7, and writes the data stored in the hand position data generating means into the nonvolatile memory 4.

Here, reference numeral 6 denotes the data read instruction means that was concretely described earlier, and that is constituted by a block comprising external switching means 6*a* to 6*d*.

The analog electronic timepiece according to this embodiment employs the aforementioned technical constitution. Upon detecting a cell voltage, therefore, the cell voltage drop-alarm hand motion condition is established, and the user renews the cell to cope with the cell voltage drop-alarm hand motion condition. Or after the passage of a predetermined period of time, the analog electronic timepiece automatically stops the timing operation and the hand moving operation under the condition in which synchronism is maintained between the hands and the timing counter, and the data stored in the timing counter are stored in the nonvolatile memory. After the power source such as a cell is replaced, the data stored in the nonvolatile memory are read into the timing counter to resume the timing operation.

According to the analog electronic timepiece of the present invention, therefore, the data are written into the memory not only when a drop in the cell voltage is detected or when the detection is made by the cell attach/detach detecting means but also when both of them are detected, unlike the prior art, contributing greatly to enhancing the commercial value of the analog electronic timepiece.

The operation procedure according to the above-mentioned embodiment of the present invention will now be described with reference to flowcharts of FIGS. 16 and 17. FIG. 16 is a flowchart explaining the procedure for operating the analog electronic timepiece 1 of the present invention, i.e., explaining the procedure of operation after the cell 2 is replaced. After the start, the RAM is initialized at a step (1). The program them proceeds to a step (2) where the data of the hand position counter 15 stored in the nonvolatile memory 4 is read. Then, at a step (3), the data of the drive polarity storage means 14 stored in the nonvolatile memory 4 is read and supplied to drive the pulse motor control means 25.

After a predetermined delay time has passed at a step (4), the booster means 16 is operated to supply a boosted voltage to the nonvolatile memory 4. Then, at a step (5), the content stored in the nonvolatile memory 4 is erased.

It is desired that the boosting operation at the step (4) is carried out for a period of, for example, 200 ms, so that the erasing effect is reliably obtained.

The program then proceeds to a step (6) where it is judged whether the cell voltage drop alarm is being indicated or not. When the answer is NO, the program proceeds to a step (7) where it is judged whether the cell voltage detecting means 12 is detecting a drop in the cell voltage or not. When the answer is NO, the program proceeds to a step (8) where it is judged whether a write signal of the cell attach/detach detecting means 7 is changing or not. When the answer is NO, the program proceeds to a step (9) where the timing operation processing is executed to carry out the ordinary timepiece function, and the program returns to the step (6) to repeat the above-mentioned steps.

When it is judged at the step (6) that the cell voltage drop alarm is being indicated, the program proceeds to a step (10) where it is judged whether a predetermined delay period set by the delay means 60 has passed or not. When the answer is NO, the program proceeds to a step (11) where the indication of the cell voltage drop alarm is continued, and the program proceeds to a step (8).

When it is judged at the step (7) that the cell voltage detecting means 12 has detected a drop in the cell voltage, the program proceeds to a step (11) where the cell voltage drop alarm is indicated, and the program proceeds to the step (8).

The step (8) judges whether the write signal of the cell attach/detach detecting means 7 has changed. When the answer is YES, the program proceeds to a step (15) where the hand drive stop means 11 is turned on. Therefore, the drive signal pulse is no longer fed from the time signal generating means 10 to the pulse motor drive means 17 via the data storage means 3, whereby the hands 19 stop moving and, at the same time, the hand position counter 15 discontinues the counting operation. The timing data at that moment are stored in the hand position counter 15 maintaining synchronism with the position data of the hands 19, and the program proceeds to a step (16).

The step (10) judges whether the predetermined delay period set by the delay means 60 has passed or not. When the answer is YES, the program proceeds to a step (12) where the hand drive stop means 11 is turned on. Therefore, no drive signal pulse is fed from the time signal generating means 10 to the pulse motor drive means 17 via the data generating means 3, whereby the hands 19 stop moving and, at the same time, the hand position counter 15 discontinues the counting operation. The timing data at that moment are stored in the hand position counter 15 maintaining synchronism with the position data of the hands 19.

Then, at a step (13), the booster means 16 is driven to feed a boosted voltage to the nonvolatile memory 4. Thus, the nonvolatile memory 4 is placed in the condition where the data written therein can be erased. The time of boosting operation employed in the step (13) may be, for example, about 200 ms.

Next, at a step (14), the data of the nonvolatile memory 4 are erased, and the boosting means 16 is operated again at a step (16) to be ready for the writing operation.

The time of the boosting operation of, for example, about 20 ms will be sufficient at the step (16). The program then proceeds to a step (17) where the timing data stored in the hand position counter 15 are read out and are written into the nonvolatile memory 4.

Thereafter, the program proceeds to a step (18) where the polarity data of drive pulse stored in the drive polarity storage means 14 is read out and is written into the nonvolatile memory 4. Then, as the cell 2 is removed, the functions of all circuits (inclusive of CPU) of the analog electronic timepiece are stopped (step (17)) END.

Figure 17:
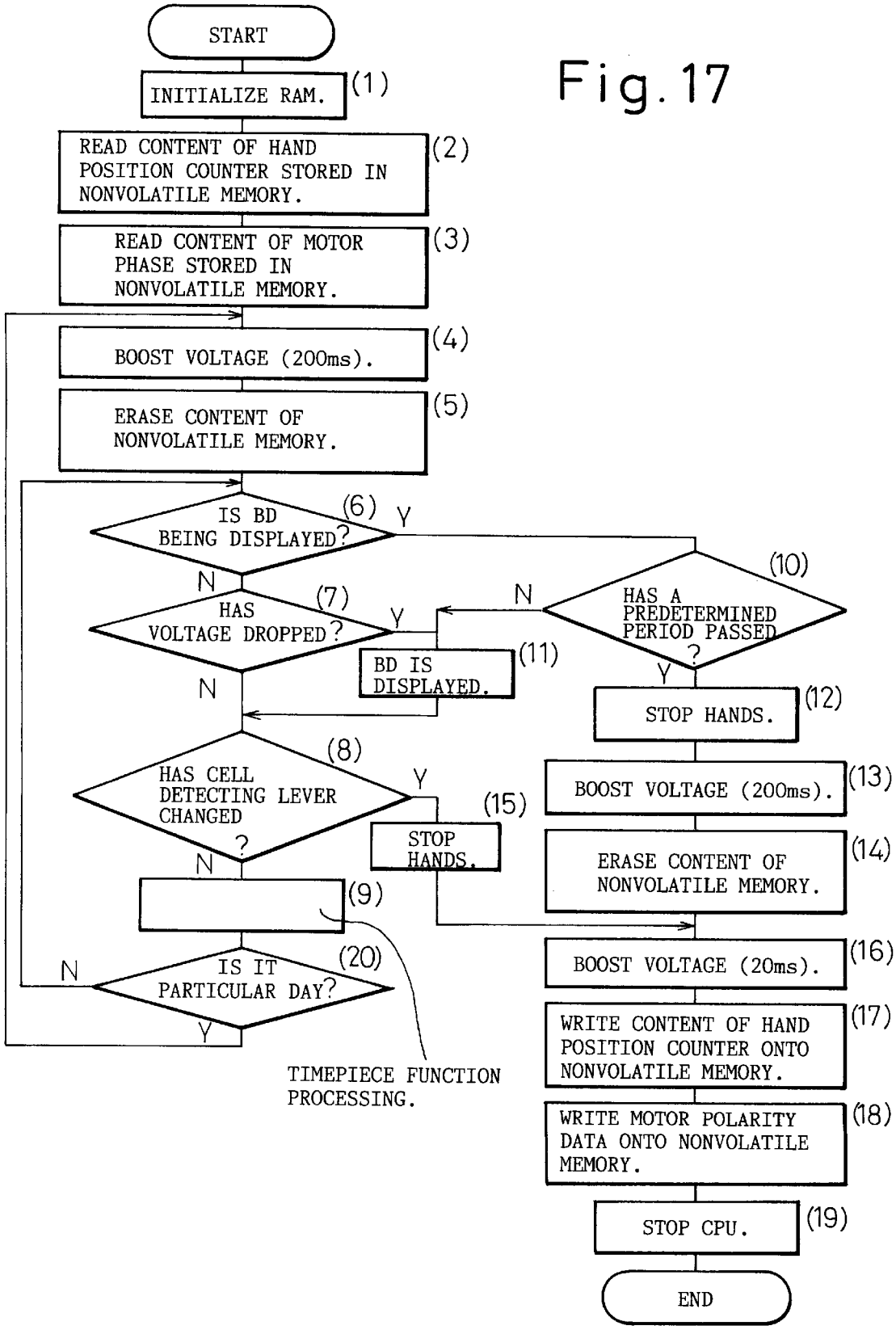
FIG. 17 is a flowchart illustrating another procedure for operating the hand display-type electronic timepiece shown in FIG. 15 of the present invention.

FIG. 17 illustrates another a flowchart showing another embodiment present invention differing from the flowchart of FIG. 16. The difference from FIG. 16 is that a step (20) is newly added after the step (9). After the ordinary timing operation is started, the operation for erasing the content of the nonvolatile memory 4 is repeated by the steps (20) and (9) at predetermined time periods. It is therefore allowed to write the contents of the hand position counter 15 and the drive polarity storage means 14 into the nonvolatile memory 4 at any time.

That is, the step (20) judges whether a predetermined particular day or time has arrived. When the answer is NO, the program returns to the step (6) to repeat the steps up to this point. When the answer is YES, the program returns to the step (4) to repeat the steps up to this point.

Another constitution of the electronic timepiece according to the present invention will be described next with reference to FIGS. 18 to 20.

Figure 18:
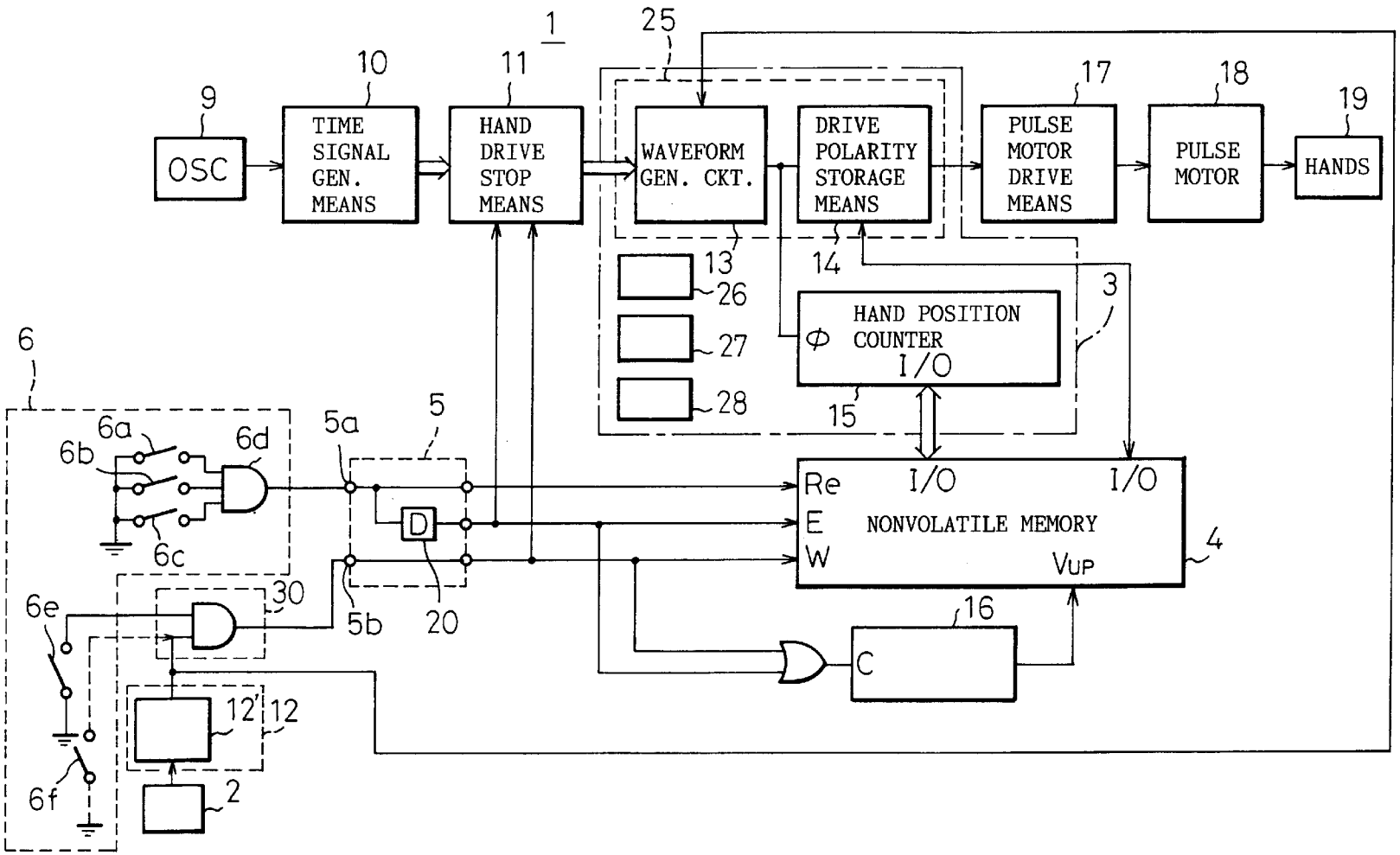
FIG. 18 is a block diagram illustrating a further constitution of the hand display-type electronic timepiece according to the present invention.

That is, as shown in FIG. 18, this embodiment is concerned with a hand display-type electronic timepiece 1 constituted by a cell 2 serving as a power source, a time signal generating means 10, a motor drive control means 25, a pulse motor drive means 17, a pulse motor 18, hands 19 driven by the pulse motor 18, and a hand position data generating means 3 which stores hand position data corresponding to the hands 19, and in which the drive control of the hands is executed according to the data from the hand position data generating means 3, wherein the improvement further comprises a hand drive stop means 11 provided between the time signal generating means 10 and the hand position data generating means, a nonvolatile memory 4 for storing hand position data stored in the hand position data generating means 3, a hand drive data control means 5 which controls at least the nonvolatile memory 4 and the hand drive stop means 11, and external switches 6*a* to 6*d* for operating the hand drive data control means 5, wherein the external switches 6*a* to 6*d* are manipulated to operate the hand drive stop means 11 in order to stop the hands, and the hand drive data control means 5 writes the data stored in the hand position data generating means 3 into the nonvolatile memory 4.

According to the hand display-type electronic timepiece of this embodiment which employs the above-mentioned technical constitution, the hand position data are initially stored in the nonvolatile memory while maintaining perfect synchronism between the hand positions and the hand position data of the hand position data generating means upon the operation by the user (e.g., upon the pushing of external switches) or upon the judgment by the hand display-type electronic timepiece itself after a drop of cell voltage below a required voltage has been confirmed and, at the same time, the functions of arithmetic processing means of the hand display-type electronic timepiece are stopped. After the power source such as a cell is replaced, furthermore, the hand position storage data stored in the nonvolatile memory are read onto the hand position counter to resume the counting operation. Therefore, operations of the hands and the hand position counter in the hand display-type electronic timepiece can be started again maintaining the synchronism that existed before the power source such as a cell was replaced.

According to the hand display-type electronic timepiece of the present invention, therefore, no complex operation is required for maintaining synchronism between the hands and the timing counter unlike the prior art. That is, without the need of effecting any particular operation for maintaining synchronism, the power source such as a cell can be replaced while automatically maintaining synchronism between the hands and the timing counter, contributing to greatly enhancing the commercial value of the hand display-type electronic timepieces.

The constitution of the hand display-type electronic timepiece according to the embodiment will now be described with reference to the drawing. FIG. 18 is a block diagram illustrating the constitution of the hand display-type electronic timepiece according to the embodiment which is realized in the form of a hand position storage-type analog electronic timepiece (hereinafter referred to as an analog electronic timepiece).

In FIG. 8, the basic constitution is the same as the one shown in FIG. 1 or 7. That is, there is shown a hand display-type electronic timepiece 1 constituted by a cell 2 serving as a power source, a time signal generating means 10, a pulse motor drive means 17, a pulse motor 18, hands 19 driven by the pulse motor 18, a hand position data generating means 3 (hereinafter referred to as data generating means), and a data storage instruction means such as a data read instruction means 6 including a plurality of external switches, and in which the drive control of the hands 19 is executed according to the data from the hand position data generating means 3, wherein an analog electronic timepiece comprises a nonvolatile memory 4 for storing hand position data that are stored in the data generating means 3, a power source voltage detecting means 12' that is provided in the data storage instruction means 12 and that detects a drop in the voltage of the cell 2, and a drive data control circuit (hereinafter referred to as control circuit) that controls at least the nonvolatile memory 4 and the data generating means 3, and a switch validating means 30 which validates part of the external switches 6*a* to 6*f* of the data read instruction means 6, wherein some of the external switches 6*a* to 6*f* are validated while the signal is being output from the power source voltage detecting means 12' that constitutes the data storage instruction means 12, so that the control circuit 5 writes the data stored in the data storage means 3 into the nonvolatile memory 4.

Even in the analog electronic timepiece of this embodiment, synchronism is maintained between the analog display means and the digital data storage means, i.e., the value of the digital counter when the power source and, in particular, a small cell is to be replaced in order to solve the problem inherent in the prior art. Concretely speaking, the data of the data storage means 3 inclusive of the position data of hands 19 in the analog display means and the data stored in the hand position counter are stored in the nonvolatile memory 4 maintaining synchronism therebetween just before the voltage of the cell is so dropped that the operation can be no longer be continued. At a moment when the renewal of the cell is finished, the counter value in synchronism with the position data of the hands stored in the nonvolatile memory 4 are returned to the original counter, and the arithmetic processing such as timing operation is started again. Therefore, the arithmetic processing such as timing operation is resumed under the condition where perfect synchronism is maintained as before the cell was replaced.

The above-mentioned constitution of the embodiment is realized by, for example, providing the data storage instruction means 12 with the power source voltage detecting means 12' which monitors the voltage of the cell 2 at all times, generating a predetermined output signal when the power source voltage detecting means 12' has detected the voltage of the cell 2 that has dropped below a predetermined voltage level, and validating the outputs of the above-mentioned external switches while the above output signal is being generated, to thereby inhibit the operation for writing the hand position data into the nonvolatile memory 4 and to stop movement of the hands 19.

Completion of the above-mentioned operation is followed by stopping the function of the arithmetic processing means which is controlling a circuit that executes in particular the timing operation processing means of the analog electronic timepiece. In other words, after the timing data of the hands 19 and the digital timing data of the data storage means 3 are stored in the nonvolatile memory 4, the function of the arithmetic processing means stops as if it were in hibernation.

In this embodiment, in particular, the external switch validating means 30 is activated by a detect signal of the power source voltage detecting circuit 12' that represents the voltage drop of the cell 2 below a predetermined threshold value. Therefore, the output produced by operating the external switch 6*e* is fed to the hand drive stop means 11 via the control circuit 5 and is further fed, as a write signal, to the write signal terminal W of the nonvolatile memory 4 and to the booster means 16. Therefore, when the user operates the external switch 6*e* after the power source voltage detecting circuit 12' has detected the voltage drop of the cell 2 below the predetermined level and has produced the detect signal (two-second hand motion is created), the hand drive stop means 11 is operated and the output signal of the time signal generating means 10 is no longer fed to the data storage means 3, causing the hand position counter 15 to come to a halt and, at the same time, the hands 19 to be stopped.

Furthermore, upon receipt of the write signal from the control circuit 5, the nonvolatile memory 4 reads the data stored in the hand position counter 15 and the polarity data stored in the drive polarity storage means 14, and writes these data therein. At this moment, when the user operates the external switch 6*e* the booster means 16 has been driven simultaneously, and thus a high voltage boosted to a level necessary for the writing operation is fed to the nonvolatile memory 4.

That is, in the hand display-type electronic timepiece of this embodiment, when the user operates the external switch 6*e* in response to the data of the power source voltage detecting circuit 12', the hand drive stop means 11 is operated, and the data of the hand position counter 15 and the data of the drive polarity storage means 14 are written into the nonvolatile memory 4.

In this embodiment, therefore, when the user operates the external switch 6*e* in response to the drop of the voltage of the cell 2, the timing data indicated by the hands 19 and the timing data of the hand position counter 15 in the data storage means 3 are written and stored in the nonvolatile memory 4 while maintaining synchronism therebetween and further maintaining synchronism between the polarity of the drive polarity storage means 14 and the polarity of the pulse motor 18. After the renewal of the cell is finished, the timing data and the polarity data stored in the nonvolatile memory 4 are read into the data storage means 3 and the timing operation is resumed. Thus, the timing operation is resumed under the condition where a perfect synchronism is maintained between the data of the hands 19 and the data of the hand position counter 15.

That is, in this embodiment, at a moment when the renewal of the cell 2 is finished, no detect signal has been output from the power source detecting circuit 12', and the output signal produced by simultaneously depressing the external switches 6*a*, 6*b* and 6*c* is input to the memory read terminal 5*a*, and the data stored in the nonvolatile memory 4 are read into the data storage means 3. In the case of this embodiment, the read signal that indicates that the analog electronic timepiece has been loaded with the new cell 2 is produced from the AND gate 6*d* when the user intentionally manipulates the three switches 6*a*, 6*b* and 6*c* simultaneously after the cell is renewed, which is a condition that does not usually exist. It is, of course, allowable to employ any constitution which produces a predetermined output signal upon detecting such a condition that the back of the analog electronic timepiece is closed or that the cell pushing plate has returned to its initial state.

Another constitution of this embodiment will be described next with reference to FIG. 19.

Figure 19:
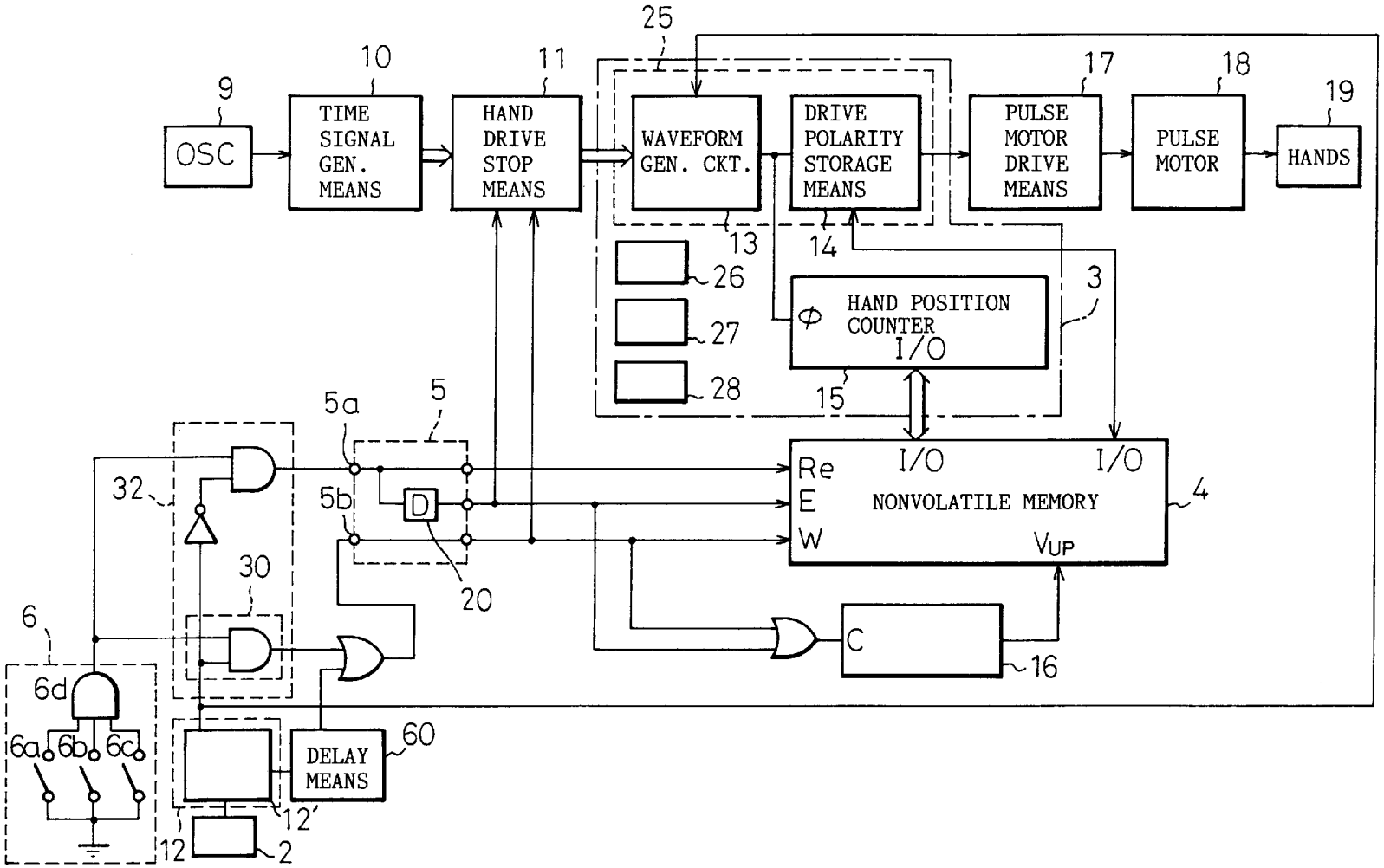
FIG. 19 is a block diagram illustrating a yet further constitution of the hand display-type electronic timepiece according to the present invention.
Figure 20:
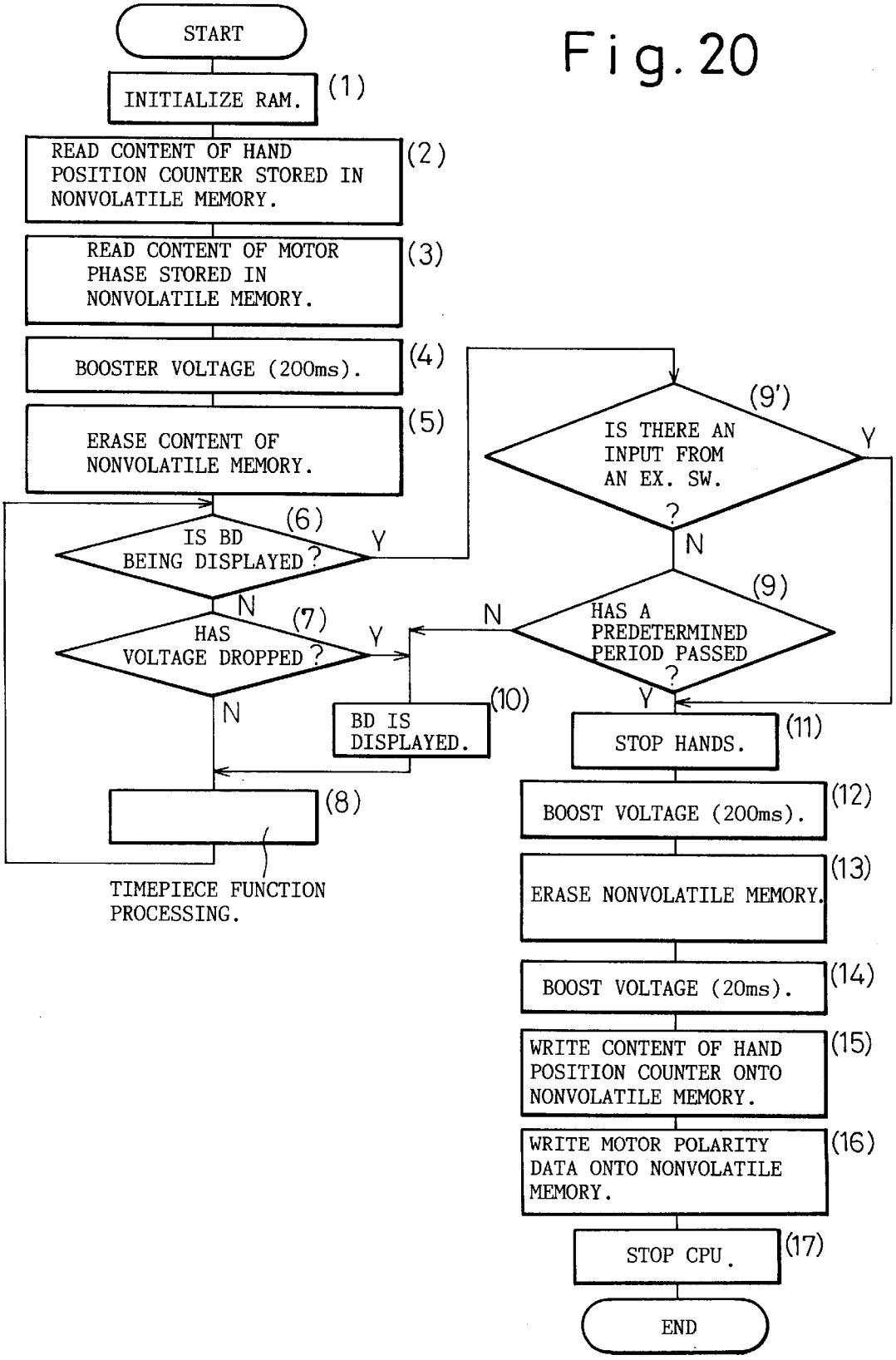
FIG. 20 is a flowchart illustrating a procedure for operating the hand display-type electronic timepiece shown in FIG. 18 of the present invention.

In the embodiment of FIG. 19, the data storage instruction means 12 and the data read instruction means 6 are not separately formed but are constituted as a unitary structure so as to exhibit both functions.

The basic constitution of FIG. 19 is the same as that of FIG. 18, but has a switch change-over means 32 and a memory write delay means 60 which operates in response to the detect signal of the power source voltage detecting circuit 12' in the data storage instruction means 12. In the electronic timepiece of FIG. 19 which is provided with the memory write delay means 60, the control circuit 5 works to write the data stored in the data storage means 3 into the nonvolatile memory 4 based on the judgement of the electronic timepiece itself. Moreover, provision of the switch change-over means 32 makes it possible to selectively carry out the operation for writing the data into the nonvolatile memory 4 and the operation for reading the data therefrom by simultaneously depressing the external switches 6*a* to 6*c* constituting the data read instruction means 6. Concretely speaking, when the voltage detecting circuit 12' constituting the data storage instruction means 12 is outputting the detect signal, the outputs of the external switches 6*a* to 6 constituting the data read instruction means 6 permit the data to be written into the nonvolatile memory 4. In other cases (e.g., immediately after the cell is loaded), the hand data written into the nonvolatile memory 4 are read out.

The constitution of this embodiment will be described in further detail with reference to FIG. 9. The principal constitution is the same as that of the hand display-type electronic timepiece shown in FIG. 18. Here, however, the switch change-over means 32 and the delay means 60 are newly provided. Owing to the provision of the switch change-over means 32, a memory write validating means 32*b* is validated by the detect signal from the power source voltage detecting circuit 12' which indicates that the voltage of the cell 2 has dropped below a predetermined threshold value, and the operation of simultaneously depressing the external switches 6*a*, 6*b* and 6*c* of the data read instruction means 6 is output to the write terminal 5*b* of the control circuit 5.

In this case, however, the inverted signal of the detect signal from the power source voltage detecting means 12' invalidates the memory read validating means 32*b*. Therefore, the operation of simultaneously depressing the external switches 6*a* to 6*c* is not output to the read terminal 5*a* but acts only upon the operation for writing into the nonvolatile memory 4. Immediately after the cell is replaced, the detect signal of the power source voltage detecting circuit 12' validates the memory read validating means 32*a* and invalidates the memory write validating means 32*b* contrary to the above. Therefore, the operation of simultaneously depressing the external switches 6*a* to 6*c* acts only upon the operation for reading from the nonvolatile memory 4. Owing to the provision of the switch change-over means 32 as described above, the operation of simultaneously depressing the external operation switches 6*a* to 6*c* can selectively act upon both the operation for writing into the nonvolatile memory 4 and the operation for reading therefrom.

According to the present invention, furthermore, the detect signal from the power source voltage detecting circuit 12' which indicates that the voltage of the cell 2 has dropped below a predetermined threshold value is further input to the delay means 60. After the passage of a predetermined period of time (e.g., six days) from when a detect signal representing the drop of power source voltage is received, the memory write delay means outputs a delay signal to the memory write terminal 5*a* so that the hand position data are written into the nonvolatile memory 4. When the voltage of the cell 2 has dropped below the predetermined threshold value, the hand position data are automatically written into the nonvolatile memory 4 after the passage of a predetermined period of time owing to the provision of the delay means 60 even when the user fails to operate the external operation switch 6.

The procedure for operating the hand display-type electronic timepiece 1 according to this embodiment will be described next with reference to a flowchart of FIG. 20. FIG. 20 is a flowchart explaining the procedure for operating the hand display-type electronic timepiece according to this embodiment, i.e., explaining the procedure of operation after the cell is replaced. After the start, the RAM is initialized at a step (1). The program then proceeds to a step (2) where the data of the hand position counter 15 stored in the nonvolatile memory 4 is read. Then, at a step (3), the data of the drive polarity storage means 14 stored in the nonvolatile memory 4 is read to drive the pulse motor control means 25.

After a predetermined delay time has passed at a step (4), the booster means 16 is operated to supply a boosted voltage to the nonvolatile memory 4. Then, at a step (5), the content stored in the nonvolatile memory 4 is erased.

It is desired that the boosting operation at the step (4) is carried out for a period of, for example, 200 ms, so that the erasing effect is reliably obtained.

The program then proceeds to a step (6) where it is judged whether the voltage drop signal of the power source voltage detecting circuit 12' is being indicated (BD is displayed) or not. When the answer is NO, the program proceeds to a step (7) where it is judged whither the voltage has dropped or not in the power source voltage detecting circuit 12'. When the answer is YES, the program proceeds to a step (10) where the waveform generating circuit 13 is controlled by the detect signal of the power source voltage detecting circuit 12' to display the detection of two-second hand motion (BD is displayed). The program then proceeds to a step (8) where the arithmetic processing is executed for the ordinary timing operation.

When the answer is NO at the step (7), the program proceeds directly to the step (8). The program then returns to the step (6) to repeat the above-mentioned steps to thereby carry out the ordinary timing operation and the operation for detecting the power source voltage. When the answer is YES at the step (6), the program proceeds to a step (9') where it is judged whether a signal is output from the external switch 6. When no signal is output, it is then judged if a predetermined delay time set by the memory write delay means 60 has passed or not. When the answer is no, the program returns to the step (10). When the answer is YES in either the step (9') or the step (9), the program proceeds to a step (11) where the hand drive stop means 11 is turned on. Therefore, no drive signal pulse is fed from the time signal generating means 10 to the pulse motor drive means 17 via the data storage means 3, whereby the hands 19 stop moving and, at the same time, the hand position counter 15 discontinues the counting operation. The timing data at this moment are then stored in the hand position counter 15 in synchronism with the position data of the hands 19.

Then, the booster means 16 is driven at a step (12), and a boosted voltage is fed to the nonvolatile memory 4. Thus, the nonvolatile memory 4 is placed under the condition where the data stored therein can be erased. The boosting operation is effected for, for example, about 200 ms in the step (12).

Then, a step (13) erases the data of the nonvolatile memory 4 and a step (14) operates the boosting means 16 again to be ready for the writing operation.

The time of boosting operation of, for example, about 20 ms will be sufficient at the step (14). The program then proceeds to a step (15) where the timing data stored in the hand position counter 15 are read out and are written into the nonvolatile memory 4.

Thereafter, the program proceeds to a step (16) where the polarity data of drive pulse stored in the drive polarity storage means 14 is read out and is written into the nonvolatile memory 4.

Then, as the cell 2 is removed, the functions of all circuits (inclusive of CPU) of the analog electronic timepiece are stopped (step (17)) END.

According to the analog electronic timepiece of this embodiment which employs the aforementioned technological constitution, the counting operation of the hand position data generating means and the movement of the hands are stopped maintaining synchronism therebetween upon judgement by the user or judgement by the analog electronic timepiece itself at a moment when it is confirmed that the power source voltage has dropped below a required voltage level, and the timing data generated by the hand position data generating means at this moment are stored as hand position data in the nonvolatile memory and, then, the functions of all circuits inclusive of the arithmetic processing means are stopped. After the cell is replaced, the timing data stored in the nonvolatile memory are read into the hand position data generating means, and then the counting operation of the hand position data generating means and the movement of the hands are resumed under the condition in which synchronism is maintained therebetween. It is thus made possible to prevent synchronism between the hands and the timing data in the analog electronic timepiece from being lost by the renewal of the cell. According to the present invention, furthermore, the polarity data of a motor drive pulse stored in the drive polarity storage means is stored in the nonvolatile memory together with the timing data when the voltage drop is confirmed, and is returned to the drive polarity storage means when the replacement of the cell is finished, so that the polarity of the motor drive pulse is set to the state that existed before the cell was replaced. This makes it possible to prevent the introduction of a pulse error that stems from the difference in the polarity of the drive pulse when the timing operation is resumed and, hence, to guarantee the operation maintaining perfect synchronism between the timing data and the hand positions. When the analog electronic timepiece of the present invention is used as a multi-functional timepiece, therefore, there is no need to carry out the operation for bringing the hands and the timing data into synchronism again after every replacement of the cell unlike the prior art.

Described below are examples of special functions added to the electronic timepiece of the present invention.

A first special function is a demonstration operation function of the hands 19. When, for example, predetermined data are read into the hand position counter 15 from the nonvolatile memory 4, the user may not be sure whether the data are really read or not. Therefore, in order that the user can recognize the fact that the predetermined data stored in the nonvolatile memory 4 are read into the hand position counter 15, the hands are caused to execute a particular motion. Such a particular motion of the hands is called demonstration operation.

For instance, a predetermined hand is turned once or the hands are vibrated maintaining a particular amplitude, which is different from the ordinary motion of the hands at a moment when the predetermined data stored in the nonvolatile memory 4 are read into the hand position counter 15.

Figure 21:
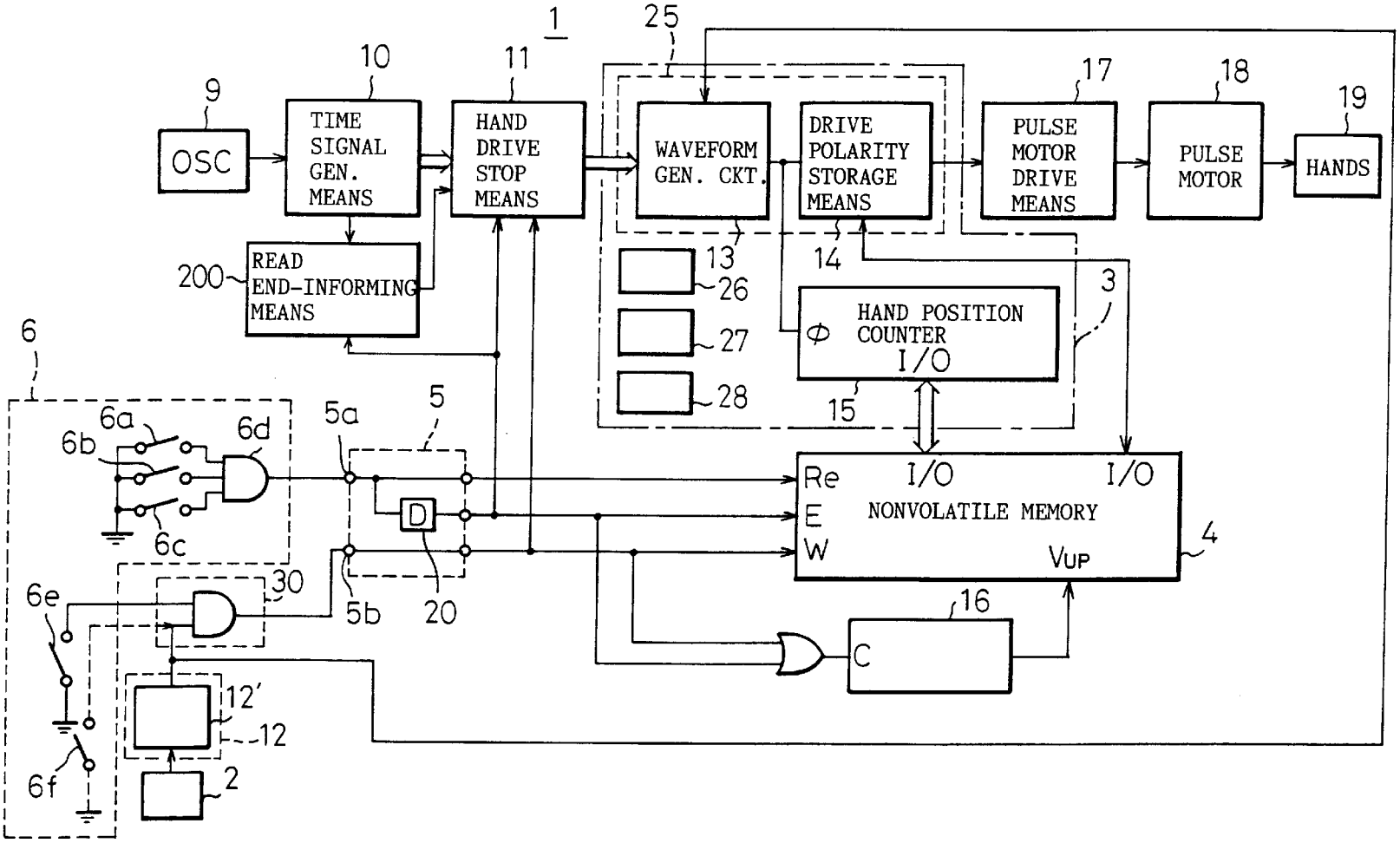
FIG. 21 is a block diagram illustrating a function of demonstration operation in the hand display-type electronic timepiece according to the present invention.

The above-mentioned demonstration operation is executed by providing a read end informing means 200 as shown in FIG. 21.

Described below is a procedure for executing the demonstration operation.

First, after the new cell 2 is loaded, the external switches 6*a*, 6*b* and 6*c* constituting the data read instruction means 6 are depressed simultaneously, so that a load instruction signal is output to the hand drive data control means 5 from the AND gate 6*d*.

Then, the hand drive data control means 5 inputs a load instruction signal to the Re terminal of the nonvolatile memory 4, whereby the hand position data stored in the nonvolatile memory 4 are written into the hand position counter 15 and the polarity data of motor are written into the drive polarity storage means 14.

Moreover, the hand drive data control means 5 outputs the load instruction signal that is delayed by a predetermined period of time through the delay circuit 20 to the hand drive stop means 11 and the read end informing means 200.

Thereafter, in response to the load instruction signal, the hand drive stop means 11 permits the passage of time signals that had been turned off. In response to a signal from the time signal generating means 10, furthermore, the read end informing means 200 generates, for example, 60 (or 60 seconds of) quick-feed pulses in order to quickly feed the hand (second hand) 19 by an amount of 60 seconds (one turn) via the hand drive stop means 11, motor drive control circuit 25 and pulse motor 18, to thereby execute the demonstration display operation from which it can be confirmed that the data of the nonvolatile memory 4 are read into the hand position counter 15 and the drive polarity storage means 14.

The next special function of the electronic timepiece according to the present invention is to easily correct the time after the operation for replacing the cell has been finished.

According to the electronic timepiece of the present invention as described earlier, provision is made of an alarm time counter that executes an alarm function, a time-differential counter for executing a global time function and similar counters in addition to the timing counter that executes the timekeeping function in order to constitute an electronic timepiece of the multi-functional type. Every time a predetermined mode is selected, therefore, predetermined data are displayed by the hands while maintaining synchronism between a predetermined counter and the hand position counter.

In an electronic timepiece of such a multi-functional type, therefore, the individual functional counters are driven based upon a correct present time of the timing counter 26. Therefore, the timing counter functions as a main counter in the electronic timepiece.

However, when the cell is once removed to carry out the operation for replacing the cell, all of the counters inclusive of the timing counter are reset, and the counted content of the timing counter becomes indefinite.

In many cases, the counted content of the timing counter is set to 0. However, when a set signal is input to all of the counters which are under the reset condition after the cell has been renewed, all of the counters commence the counting operation starting from 0, and the timing counter commences the counting operation starting from count 0, as a matter of course.

Therefore, a considerable period of time is consumed by the adjusting operation for setting the count number of the timing counter to the correct present time.

Figure 22:
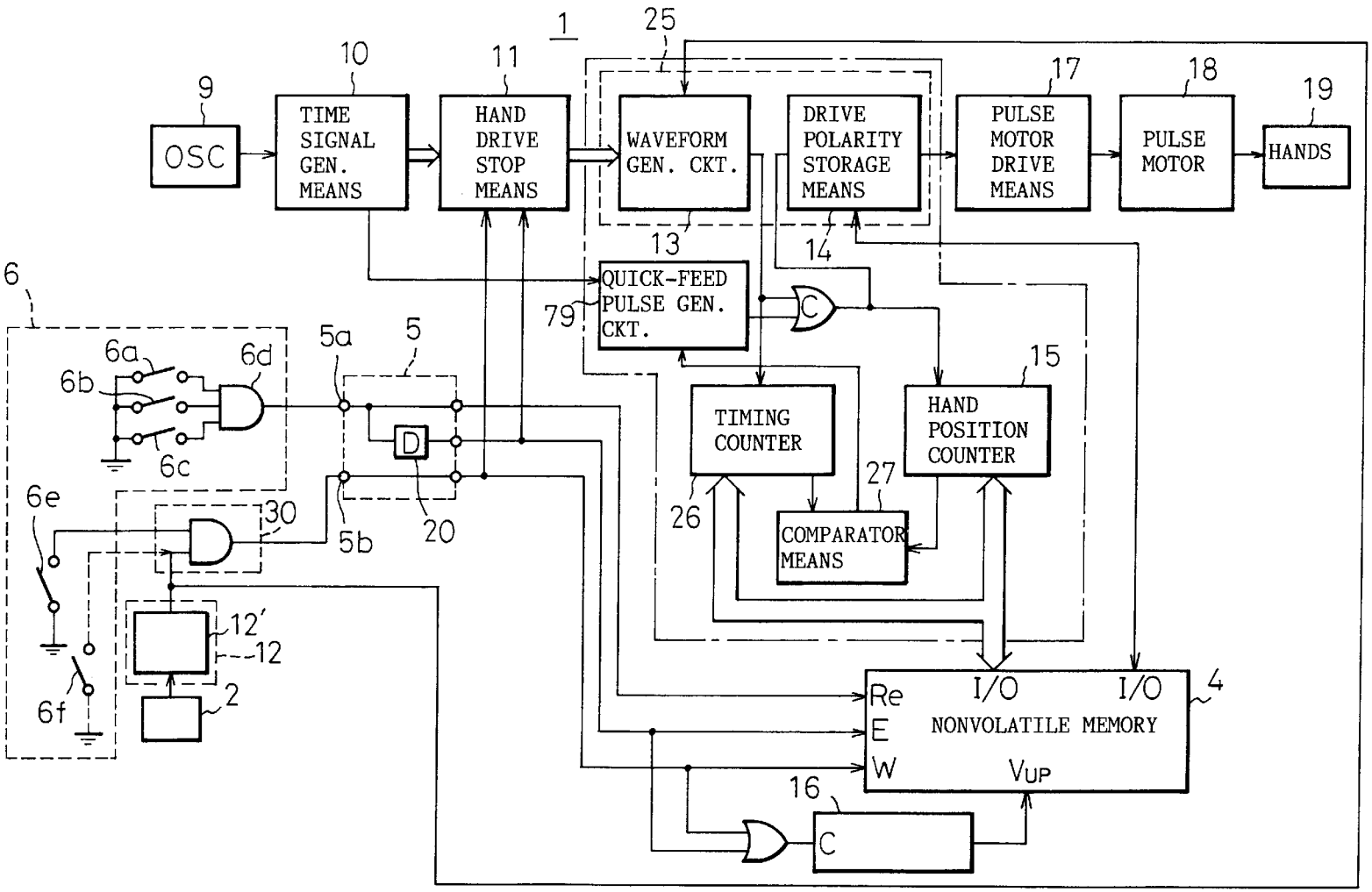
FIG. 22 is a block diagram illustrating a function for reading the data stored in a nonvolatile memory onto both a timing counter and a hand position counter in the hand display-type electronic timepiece according to the present invention.

According to the electronic timepiece of the present invention as shown in FIG. 22, therefore, the data of the hand position counter 15 of just before the cell was removed and the data of the timing counter 25 (perfect synchronism has been maintained between them) are stored in the nonvolatile memory 4 and, after the operation for replacing the cell is finished, the data of the hand position counter 15 and the data of the timing counter 26 stored in the nonvolatile memory 4 are returned to the respective counters.

Owing to the employment of the above-mentioned constitution, the time data of just before the cell was removed is set in the timing counter 26. Therefore, even if a time of 5 minutes is required to replace the cell, the timing data of 5 minutes before has been input to the timing counter 26. Accordingly, the data of the timing counter 26 can be corrected to the correct present time by simply correcting the delay of 5 minutes. After the cell is replaced, therefore, the operation for correcting the timing counter 26 can be considerably shortened and simplified compared with those of the prior art.

Described below is an operational procedure according to the above-mentioned embodiment.

When the external switch 6*e* is depressed while the voltage detect signal is being output from the cell voltage detecting circuit 12', a storage instruction signal is output to the hand drive data control means 5 via the switch validating means 30.

Next, the hand drive data control means 5 inputs the storage instruction signal to the hand drive stop means 11 to turn the hand drive stop means 11 on, whereby passage of the time signal is stopped, and the counting operations of the hand position counter 14 and the timing counter 26 are stopped, the boosting circuit 16 is operated, and the data of the hand position counter 14 or the timing counter 26 are written into the nonvolatile memory 4.

Then, after the new cell 2 is loaded, the external switches 6*a*, 6*b* and 6*c* are simultaneously depressed, so that a load instruction signal is output to the hand drive data control means 5 from the AND gate 6*d*.

The hand drive data control means 5 inputs the load instruction signal to the Re terminal of the nonvolatile memory 4, whereby the hand position data stored in the memory 4 are written into the timing counter 26 or the hand position counter 15, and the polarity data of the motor is written into the drive polarity storage means 14.

Moreover, the hand drive data control means 5 outputs the load instruction signal that is delayed by a predetermined period of time through the delay circuit 20 to the hand drive stop means 11.

The hand drive stop means 11 is turned off in response to the load instruction signal and permits the passage of the time signal.

Next, when the timing counter 26 in the electronic timepiece of the present invention is to be corrected to a precise present time, the time data transmitted as radio waves from a certain station are received by a suitable receiving means, and the time data of the timing counter 26 is corrected based upon the above data.

Figure 23:
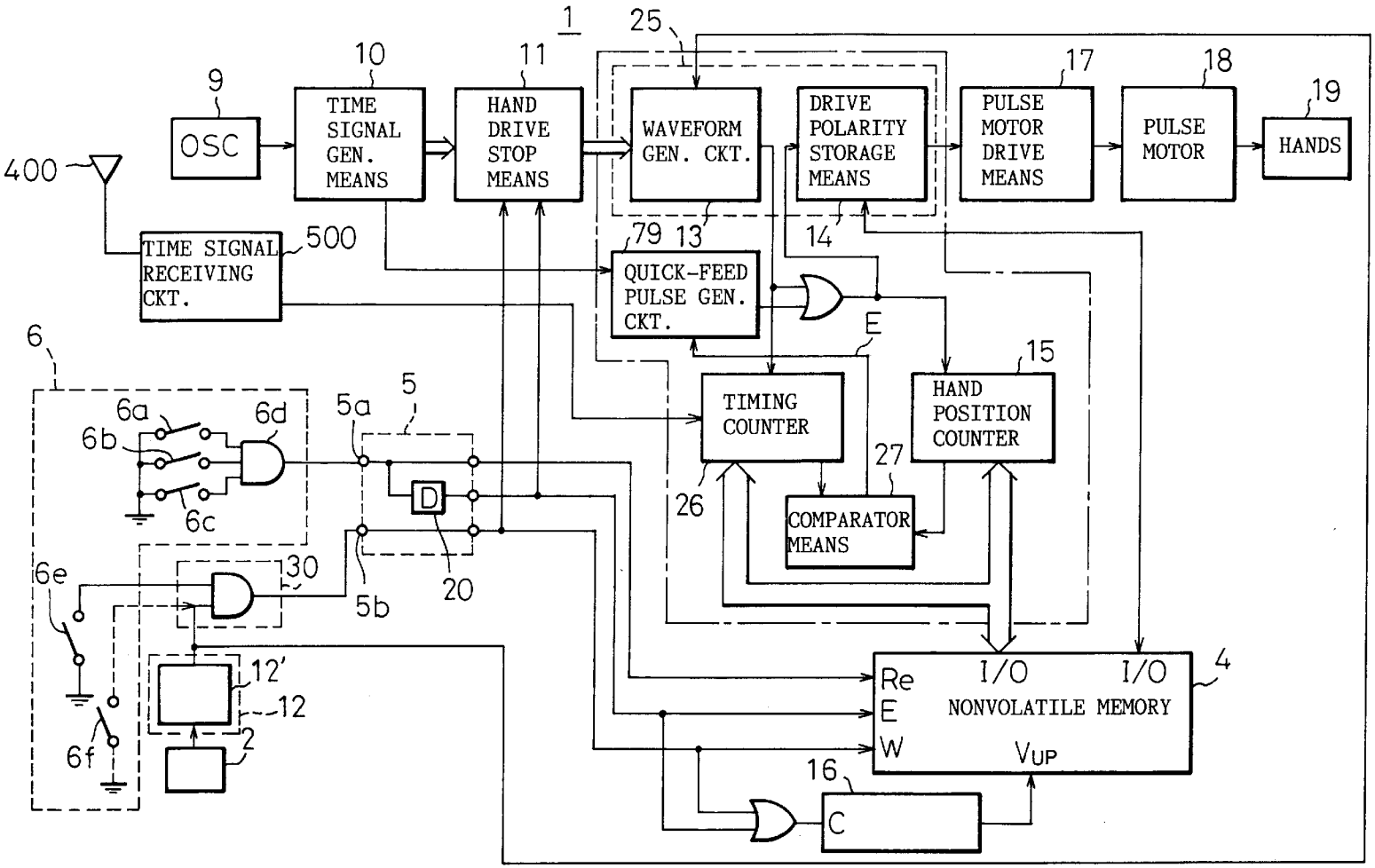
FIG. 23 is a diagram explaining a method of correcting time data in a wireless analog/digital electronic timepiece according to the present invention.

Concretely speaking as shown in FIG. 23, the time radio waves received by an antenna 400 are detected by a time signal receiving circuit 500, and the correct present time is stored in the timing counter 26.

The procedure of operation according to the above-mentioned embodiment of the invention will now be described. First, when the external switch 6*e* is depressed while a voltage detect signal is being output from the cell voltage detecting means 12, a storage instruction signal is output to the hand drive data control means 5 via the switch validating means 301.

Then, the hand drive data control means 5 inputs the storage instruction signal to the hand drive stop means 11 to turn the hand drive stop means 11 on, whereby passage of the time signal is stopped, and counting operations of the hand position counter 14 and the timing counter 26 are stopped, and the booster circuit 16 is operated to write the data of the hand position counter 14 or the timing counter 26 into the nonvolatile memory 4.

Then, after the new cell 2 is loaded, the external switches 6*a*, 6*b* and 6*c* are simultaneously depressed, so that a load instruction signal is output from the AND gate 6*d* to the hand drive data control means 5.

The hand drive data control means 5 then feeds the load instruction signal to the Re terminal of the nonvolatile memory 4, whereby the hand position data stored in the memory 4 are written into the timing counter 26 or the hand position counter 15, and the polarity data of the motor is written into the drive polarity storage means 14.

Then, the hand drive data control means 5 outputs the load instruction signal that is delayed by a predetermined period of time through the delay circuit 20 to the hand drive stop means 11.

The hand drive stop means 11 is turned off in response to the load instruction signal and permits the passage of time signals.

The time signal receiving circuit 500 that has received time data signals through the antenna 400 sets the time data in the timing counter 26.

The comparator means 27 is always monitoring the coincidence between the timing counter 26 and the hand position counter 15. When the timing counter 26 on which new time data are set from the time signal receiving circuit 500 are no longer coincident with the hand position counter 15, the comparator means 27 outputs a noncoincidence signal E to the pulse generating circuit 79.

In response to the noncoincidence signal E, the quick-feed pulse generating circuit 79 receives signals from the time signal generating means 10 and outputs quick-feed pulses to the motor drive control circuit 25 and the hand position counter 15.

As the content of the hand position counter 15 comes into agreement with the content of the timing counter 26, the comparator means 27 ceases to output the noncoincidence signal E, and the quick-feed pulse generating circuit 79 stops generating the quick-feed pulse, and whereby the two counters carry out the counting operations in synchronism with each other.

In an analog hand display-type electronic timepiece according to the above-mentioned embodiment of the present invention, when the voltage of the cell which is the power source has dropped, the data of the hands and the data of the timing counter are stored in the nonvolatile memory maintaining synchronism therebetween and when the new cell is loaded through the operation for replacing the cell, the timing operation is resumed under the condition in which the data of the hands and the data of the timing counter are in synchronism with each other, thus eliminating the problem inherent in the prior art and permitting the cell to be replaced without the need of performing a complex and cumbersome operation for maintaining synchronism between the hands and the timing counter. It need not be pointed out that the technique for replacing the cell of the present invention can be adapted not only to the analog hand display-type electronic timepieces, but also to all electronic devices that involve the above-mentioned problem.

The invention can be widely adapted, for instance, to electronic devices such as an electronic notebook, portable calculator, electronic dictionary and the like that have been increasingly used in recent years.

That is, another object of the present invention is to provide electronic devices which maintain synchronism between predetermined data and the content of a predetermined timing counter and does not lose predetermined stored data even when the cell is replaced by the manufacturer of the electronic devices such as the analog-type multi-functional electronic timepieces or by the user of the electronic device, despite their simple constitutions, eliminating the problem inherent in the aforementioned prior art.

Figure 24:
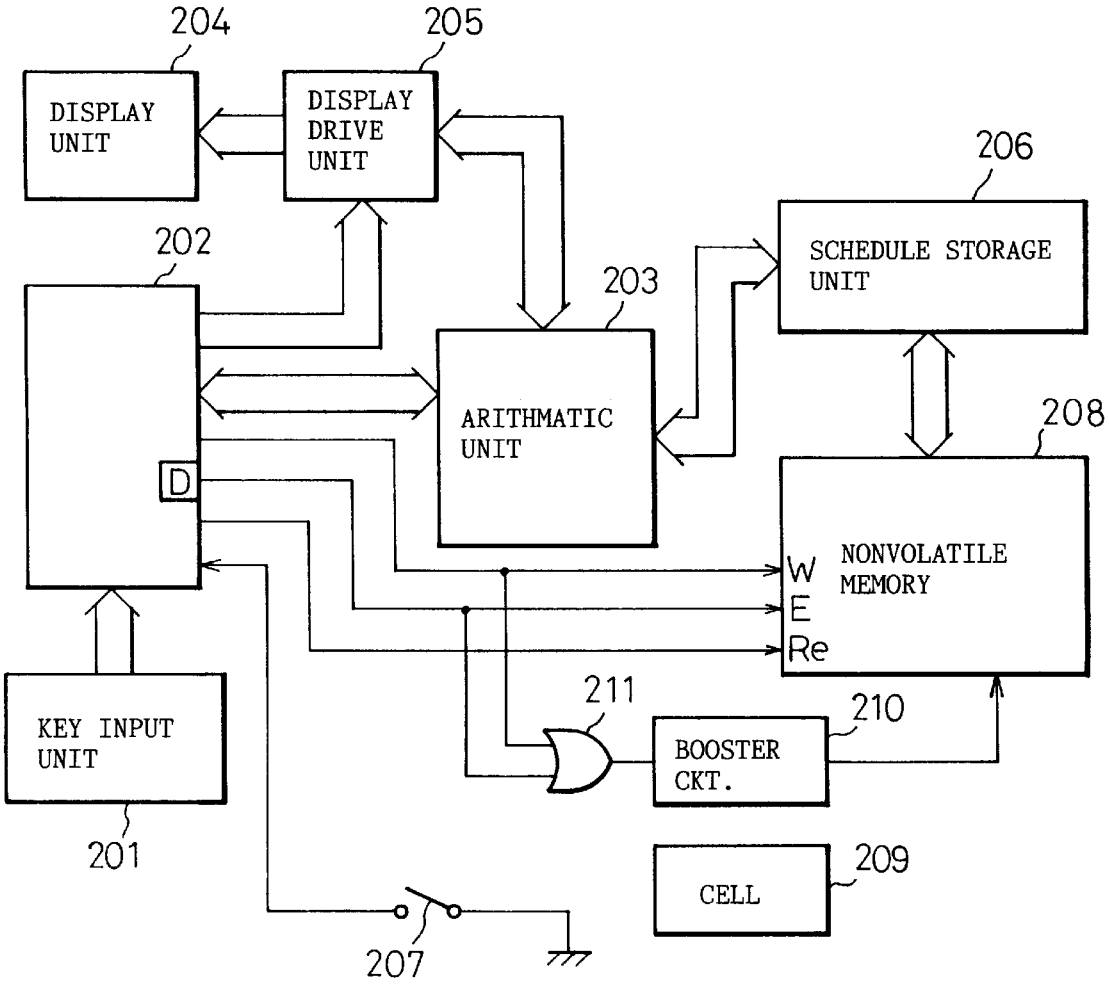
FIG. 24 is a block diagram explaining the constitution of an electronic notebook which is an example of the electronic device according to the present invention.

In order to achieve the above-mentioned object, the present invention basically employs the following technical constitution as shown in FIG. 24. That is, an electronic device 1 comprising a cell 209 serving as a power source, a data holding means 206 which holds data of the electronic device, a nonvolatile memory 208, and a data control means which controls at least the nonvolatile memory 208 and the data holding means 206, wherein provision is made of a power source attach/detach detecting means 207 which functions by being linked to the operation of attaching or detaching the cell 209, and the data control means writes the data held by the data holding means 206 into the nonvolatile memory 208 in response to a storage instruction signal from the power source attach/detach detecting means 207.

According to the embodiment of the present invention, furthermore, the cell attach/detach detecting means 207 has an attach/detach notice detecting means the same as the one mentioned earlier which notifies in advance the removal of the cell 209 under the condition where the cell 209 is loaded in the electronic device 1, and an attach/detach notice detect signal from the attach/detach notice detecting means is the data storage instruction signal.

Moreover, the attach/detach notice detecting means according to the present invention has a switching means which is linked to the operation for removing a cell pushing plate that pushes the cell under the condition where the cell is maintaining an electric connection, or has a switching means which is linked to the operation for removing the back of the electronic device that may be an electronic timepiece.

That is, the electronic device that may be the electronic timepiece according to the present invention comprises a power source consisting of a cell, a data storage means which stores processing data of the electronic device, a nonvolatile memory, and a control circuit which controls at least the nonvolatile memory and the data storage means, wherein provision is made of a power source attach/detach detecting means which functions by being linked to the operation of attaching or detaching the power source, and the control circuit writes the data stored in the data storage means into the nonvolatile memory in response to an output signal from the power source attach/detach detecting means.

The electronic device according to the present invention has a function of displaying particular data in a predetermined analog form as mentioned above, and arithmetically processes the predetermined data as digital data and stores them in a predetermined storage means and at the same time displays the predetermined data by using the analog display means. That is, the present invention can be adapted to any constitution provided it is so constituted as to control means having an analog display function with digital data.

As an embodiment of the electronic device of the present invention, described below is a case where the technology for replacing the cell of the invention is adapted to an electronic notebook having a schedule function. FIG. 24 is a block diagram illustrating the circuit of an electronic notebook with a schedule registering function according to the embodiment of the present invention, wherein reference numeral 201 denotes a key input unit consisting of a keyboard, 202 denotes a control unit which outputs data signals and various control signals upon receiving a signal from the key input unit 201, reference numeral 203 denotes an arithmetic unit which executes arithmetic processing based upon data signals and various control signals from the control unit 202, and 204 a display unit which displays data output from the control unit 202 and the arithmetic unit 203 via a display drive unit. Reference numeral 206 denotes a schedule storage unit for registering schedule data processed by the arithmetic unit, and 209 denotes a cell which feeds electric power to the whole circuit. Reference numeral 208 denotes a nonvolatile memory which stores and backs up the data of the schedule storage unit 206 when the cell 209 is to be replaced, and is operated based on an attach/detach notifying signal A, a read signal B and an erase signal C output from the control unit 202. Reference numeral 207 denotes a switch constituting the cell attach/detach detecting means, 210 a booster circuit for operating the nonvolatile memory 208, and 211 denotes an OR gate that outputs an operation signal based on an attach/detach notifying signal A and an erase signal C from the control unit 202.

In this embodiment, the control unit 202 corresponds to the hand drive data control means 5, and the schedule storage unit 206 corresponds to the data holding means of the invention.

Operation of the embodiment will now be described. In this embodiment, the schedule registering function has been widely known and is not described here, since it does not play an important role in the gist of the present invention. Therefore, described below is the operation for replacing the cell only.

When the voltage of the cell 209 so drops that it must be replaced, an indication (not shown) notifying the replacement of the cell is output to the display unit 204 in response to a detect signal from a widely known cell voltage detecting means (not shown). Upon seeing this indication, the user replaces the cell. As the back or the cell pushing plate is removed to remove the cell 209 from the electronic notebook in the same manner as with the aforementioned hand display-type electronic timepiece, the switch 207 is turned on under the condition where the cell 209 is connected. Then, the attach/detach notifying signal A which is the storage instruction signal is input to the control unit 202 from the switch 207, and the attach/detach notifying signal A is input to the terminal W of the nonvolatile memory 208 from the control unit 202 and is further input to the booster circuit 210 via the OR gate 211, whereby the booster circuit 210 is operated.

Being supplied with a boosted voltage from the booster circuit 210, the nonvolatile memory 208 stores the schedule data in the schedule storage unit 206.

Described below is the operation for returning the schedule data back to the schedule storage unit 206 from the nonvolatile memory 208. Under the condition where the old cell 209 is removed and the new cell 209 is loaded, the data in the schedule storage unit 206 are indefinite or are erased.

When the power source of the electronic pocketbook is turned on to input a signal from the key input unit 201 through a particular key operation, the read signal B is output to the terminal Re of the nonvolatile memory 208 from the control unit 202, and the schedule data in the nonvolatile memory 208 are newly written into the schedule storage unit 206 and are stored therein.

After the schedule data are written into the schedule storage unit 206, the read signal B and the delayed erase signal C are input to the terminal E of the nonvolatile memory 208 as in the aforementioned embodiment, and the schedule data in the nonvolatile memory 208 are erased.

In order to solve the problem inherent in the prior art according to the electronic device of the present invention, synchronism is maintained between the analog display means and the digital data storage means when the power source and, especially, a small cell used in the electronic device is to be replaced. Concretely speaking, the data of the hand position data generating means 3 inclusive of hand position data of the analog display means and the data stored in the counter are stored in the nonvolatile memory 4 maintaining synchronism therebetween and when the operation for replacing the cell is finished, the hand position data stored in the nonvolatile memory 4 and the value of the counter which have been in synchronism with each other are returned to the initial counter, and the arithmetic processing such as timing operation is resumed. Therefore, the arithmetic processing such as the timing operation is resumed from when the arithmetic processing operation is started again under the condition where the two are in perfect synchronism with each other as before the cell was replaced.

The aforementioned constitution of the present invention is executed as concretely described below. For instance, the operation for attaching and detaching the cell is constituted by the first operation which anticipates the operation for removing the cell 2 under the condition where the cell 2 is maintaining electrical connection to the electronic device 1 and the second operation by which the cell 2 is really removed from the electronic device. The operation for removing the cell 2 is detected by a suitable detecting means such as by the power source attach/detach detecting means 7 of FIG. 1, and the data of the hand position data generating means 3 are written into the nonvolatile memory 4 under the condition where the cell 2 is still connected to the electronic device. Then, after the cell is removed, the functions of the electronic device are all stopped.

According to the present invention, the data necessary for the synchronous operation are all stored in the nonvolatile memory 4 while the circuits of the electronic device are still functioning. Therefore, the arithmetic processing of the electronic device can be resumed maintaining synchronism without requiring any particular operation.

We claim:

1. A hand display electronic timepiece having a battery cell serving as a power source, comprising:

time signal generating means;

a pulse motor connected to drive hands of the hand display;

means for driving the pulse motor;

means for controlling the pulse motor driving means;

volatile hand position data generating means for generating volatile hand position data corresponding to the position of said hands, the drive control of the hands being executed according to the generated hand position data;

hand drive stop means, when operated, for stopping said hands and said hand position data generating means under a condition in which synchronism is maintained therebetween;

a non-volatile memory for storing the generated hand position data;

hand drive data control means for controlling at least said non-volatile memory and said hand drive stop means; and data storage instruction means for generating a storage instruction signal to operate the hand drive data control means, the hand drive data control means being responsive to the storage instruction signal to write the volatile hand position data into the non-volatile memory by activating an installed booster circuit, to operate the hand drive stop means and further to erase the data in said non-volatile memory by activating the installed booster circuit.

2. A hand display-type electronic timepiece according to claim 1, wherein said hand position data generating means includes at least a timing counter and a hand position counter.

3. A hand display-type electronic timepiece according to claim 1, wherein said hand drive data control means controls said hand position counter and said motor drive control means in a manner in which they are linked together.

4. A hand display-type electronic timepiece according to claim 2, wherein said motor drive means includes a waveform generating means and a drive polarity storage means which changes an output signal from said waveform generating means into a motor drive signal having a different polarity and stores the polarity thereof.

5. A hand display-type electronic timepiece according to claim 2 wherein the data of said hand position counter are written into said non-volatile memory.

6. A hand display-type electronic timepiece according to claim 4, wherein the hand position data of said hand position counter and the polarity data of said drive polarity storage means are written into said non-volatile memory.

7. A hand display-type electronic timepiece according to claim 6, wherein when a storage instruction signal is output from said data storage instruction means, said hand drive data control means is operated to drive said hand drive stop means, whereby movement of said hands is stopped, the hand position data of said hand position data generating means and the polarity data of the drive polarity storage means are written into said nonvolatile memory, and then the hand display-type electronic timepiece discontinues all of its functions by itself.

8. A hand display-type electronic timepiece according to claim 1, wherein said hand drive stop means is between the time signal generating means and said hand position data generating means.

9. A hand display-type electronic timepiece according to claim 1 or 2 or 3 or 4 or 5 or 6 or 7, wherein said data storage instruction means is a voltage detecting means capable of detecting a drop in the cell voltage, and said data storage instruction signal is a voltage detect signal of said voltage detecting means.

10. A hand display-type electronic timepiece according to claim 9, wherein said voltage detecting means includes a delay means.

11. A hand display-type electronic timepiece according to claim 10, wherein after said voltage detecting means has been operated, said voltage detect signal is output after the passage of a predetermined delay time determined by said delay means.

12. A hand display-type electronic timepiece according to claim 11, wherein said delay time is a given period of time selected from a range of one to seven days after the operation point of said voltage detecting means.

13. A hand display-type electronic timepiece according to claim 1 or 2 or 3 or 4 or 5 or 6 or 7, wherein the data storage instruction means is a cell attach/detach detecting means which functions being linked to the operation of attaching or detaching the cell, and the attach/detach signal from said cell attach/detach detecting means includes a data storage instruction signal.

14. A hand display-type electronic timepiece according to claim 13, wherein the cell attach/detach detecting means has an attach/detach notice detecting means which notifies the removal of the cell from the hand display-type electronic timepiece, and an attach/detach notice detecting signal from said attach/detach notice detecting means is the data storage instruction signal.

15. A hand display-type electronic timepiece according to claim 14, wherein said attach/detach notice detecting means is a switching means which is linked to the operation for removing the cell pushing plate that is pushing the cell under the condition where the cell is maintaining electrical connection.

16. A hand display-type electronic timepiece according to claim 14, wherein said attach/detach notice detecting means is a switching means which is linked to the operation for removing the back of the hand display-type electronic timepiece.

17. A hand display-type electronic timepiece according to claim 1, wherein said data storage instruction means is constituted by a cell voltage detecting means which detects a drop in the cell voltage and a cell attach/detach detecting means which functions by being linked to the operation of attaching or detaching of the cell, and said hand drive data control means controls said hand drive stop means in response to either a voltage detect signal from the cell voltage detecting means or an attach/detach data signal from the cell attach/detach detecting means, in order to stop the hands and to write the data stored in the hand position data generating means into the nonvolatile memory.

18. A hand display-type electronic timepiece according to claim 1 or 2 or 3 or 4 or 5 or 6 or 7, wherein provision is made of a cell load instruction means which outputs a cell load signal that indicates the loading of a new cell, and said hand drive data control means reads the data stored in the nonvolatile memory into said hand position data instruction signal from said cell load instruction means.

19. A hand display-type electronic timepiece according to claim 18, wherein said cell load instruction means is constituted by a plurality of buttons provided for the hand display-type electronic timepiece, and said cell load instruction signal is the one that is generated by simultaneously depressing said plurality of buttons.

20. A hand display-type electronic timepiece according to claim 18, wherein said cell load instruction means is a power-on reset circuit.

21. A hand display-type electronic timepiece according to claim 18, wherein said hand drive data control means has a delay means which de-energizes said hand drive stop means so that the hands start moving when a predetermined delay time has passed after the data stored in the nonvolatile memory had been read into the hand position data generating means in response to the load instruction signal.

22. A hand display-type electronic timepiece according to claim 21, wherein said delay time has been set to a period of from when predetermined data are read from said nonvolatile memory into said hand position data generating means until when said hand position data generating means is electrically stabilized.

23. A hand display-type electronic timepiece according to claim 21, wherein said hand drive data control means executes the operation for erasing the content of the nonvolatile memory when a predetermined delay time has passed after the data stored in said nonvolatile memory had been read into said hand position data generating means.

24. A hand display-type electronic timepiece according to claim 18, wherein said hand drive data control means writes the hand position data stored in said nonvolatile memory into the hand position counter in response to the cell load instruction signal, and writes the polarity data into the drive polarity storage means.

25. A hand display-type electronic timepiece according to claim 24, wherein said hand drive data control means writes the hand position data stored in said nonvolatile memory into the timing counter in response to said cell load instruction signal.

26. A hand display-type electronic timepiece according to claim 18, wherein provision is made of a demonstration circuit which generates a demonstration signal in response to said cell load instruction signal, and the hands are allowed to execute a predetermined demonstration motion in response to said demonstration signal.

27. A hand display-type electronic timepiece according to claim 26, wherein said demonstration circuit outputs a predetermined number of quick-feed pulses as said demonstration signals.

28. A hand display-type electronic timepiece according to claim 26, wherein said demonstration circuit is operated by an output signal from the delay means which is operated by said cell load instruction signal.

29. A hand display-type electronic timepiece according to claim 27, wherein said demonstration signal is a quick-feed signal which quickly feeds said hands by one turn.

30. A hand display-type electronic timepiece according to claim 2, wherein said hand display-type electronic timepiece has a receiving circuit that receives time data, and the time data received by said receiving circuit are written into said timing counter.

31. A hand display-type electronic timepiece according to claim 1, wherein said hand drive data control means activates said booster circuit after operating said hand drive stop means, in order to erase the data in said non-volatile memory before writing the volatile hand position data into the non-volatile memory.

32. A hand display-type electronic timepiece according to claim 13, wherein said hand drive data control means erases the data in said nonvolatile memory at a predetermined time.

33. A hand display-type electronic timepiece according to claim 13, wherein said hand drive data control means erases the data in said nonvolatile memory at predetermined time intervals.

34. A hand display-type electronic timepiece according to claim 33, wherein the cell attach/detach detecting means includes an attach/detach notice detecting means which notifies the removal of the cell from the hand display-type electronic timepiece, and an attach/detach notice detecting signal from said attach/detach notice detecting means is the data storage instruction signal.

35. A hand display-type electronic timepiece according to claim 1, wherein said hand drive data control means activates said booster circuit at a predetermined time in order to erase the data in said non-volatile memory.

36. A hand display-type electronic timepiece according to claim 1, wherein said hand drive data control means activates said booster circuit at predetermined time intervals in order to erase the data in said non-volatile memory.

* * * * *

UNITED STATES PATENT AND TRADEMARK OFFICE

CERTIFICATE OF CORRECTION

PATENT NO. : 6,072,752
DATED : June 6, 2000
INVENTOR(S) : Kiyotaka IGARASHI et al.

It is certified that error appears in the above-identified patent and that said Letters Patent is hereby corrected as shown below:

* Title page, item [63], delete in its entirety and substitute therefor: --[63] Continuation of application No. 08/167,855 file Dec. 23, 1993, abandoned, which is a 371 of PCT/JP93/00551, filed April 27, 1993, abandoned--.

* Claim 9, col. 41, line 42, after "claim 1", insert --or 31--.

* Claim 13, col. 41, line 60, after "claim 1", insert --or 31--.

* Claim 14, col. 41, line 67, "claim 13" should read --claim 32--, and "has" should read --includes--.

Claim 18, col. 42, line 34, after "hand position data", insert --generating means in response to said cell load--.

Signed and Sealed this

Seventeenth Day of April, 2001

Nicholas P. Godici

*Attest:*

NICHOLAS P. GODICI

*Attesting Officer*

*Acting Director of the United States Patent and Trademark Office*

072,752